US006427653B1

(12) United States Patent
Hara et al.

(10) Patent No.: US 6,427,653 B1
(45) Date of Patent: Aug. 6, 2002

(54) SYSTEM FOR DRIVING AND CONTROLLING CAM FOR INTERNAL COMBUSTION ENGINE

(75) Inventors: Seinosuke Hara; Makoto Nakamura, both of Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/697,148

(22) Filed: Oct. 27, 2000

(30) Foreign Application Priority Data

| | | |
|---|---|---|
| Oct. 29, 1999 | (JP) | 11-309140 |
| Mar. 14, 2000 | (JP) | 2000-069985 |
| Jun. 30, 2000 | (JP) | 2000-197556 |
| Aug. 10, 2000 | (JP) | 2000-242228 |

(51) Int. Cl.[7] ..... F01L 1/34

(52) U.S. Cl. ..... 123/90.17; 123/568 R; 123/90.18; 123/90.6

(58) Field of Search ..... 123/90.17, 90.12, 123/90.13, 90.16, 90.18, 90.27, 90.6, 188.1, 198 F; 74/567, 568 R

(56) References Cited

U.S. PATENT DOCUMENTS

| | | | | |
|---|---|---|---|---|
| 4,404,937 A | * | 9/1983 | Leitermann | 123/198 F |
| 4,794,893 A | * | 1/1989 | Masuda et al. | 123/90.17 |
| 4,870,872 A | * | 10/1989 | Parsons | 74/568 R |
| 5,333,579 A | * | 8/1994 | Hara et al. | 123/90.17 |
| 5,494,009 A | * | 2/1996 | Yamada et al. | 123/90.17 |
| 5,645,022 A | * | 7/1997 | Yamamoto et al. | 123/90.17 |
| 5,687,681 A | * | 11/1997 | Hara | 123/90.17 |
| 5,813,377 A | * | 9/1998 | Matsunaga | 123/90.17 |
| 5,855,190 A | * | 1/1999 | Matsunaga | 123/90.17 |
| 5,924,334 A | * | 7/1999 | Hara et al. | 74/568 R |

FOREIGN PATENT DOCUMENTS

| | | |
|---|---|---|
| JP | 1-157211 | 10/1989 |
| JP | 3-77005 | 8/1991 |

* cited by examiner

*Primary Examiner*—Teresa Walberg
*Assistant Examiner*—Fadi H. Dahbour
(74) *Attorney, Agent, or Firm*—Foley & Lardner

(57) ABSTRACT

An internal combustion engine includes a cam which actuates a valve by torque of a camshaft and is movable in the radial direction of the camshaft and includes a lift portion which moves forward and backward in the direction of the valve, a support mechanism which rotates the cam with the camshaft, and a device which engages the cam with the camshaft and releases the cam from the camshaft in accordance with engine operating conditions.

27 Claims, 38 Drawing Sheets

SYSTEM FOR DRIVING AND CONTROLLING CAM FOR INTERNAL COMBUSTION ENGINE

BACKGROUND OF THE INVENTION

The present invention relates to systems for driving and controlling cams for internal combustion engines.

One of the conventional systems for driving and controlling cams for internal combustion engines is disclosed, for example, in JP-U 3-77005. This system includes a camshaft rotatably supported on a cylinder head of an internal combustion engine through a bearing to rotate in synchronism with a crankshaft, and a raindrop-shaped cam arranged at the outer periphery of the camshaft to open an intake or exhaust valve against a biasing force of a valve spring. The cam is rotatable relative to the camshaft. A circular groove is formed in an inner peripheral surface of the cam, which is in slide contact with an outer peripheral surface of the camshaft, to be precise, in the inner peripheral surface on the side of a cam lift. On the other hand, a hole is radially formed in the camshaft to correspond to the groove. A pin is arranged in the hole to be capable of moving forward and backward from the outer peripheral surface of the camshaft for engagement and disengagement from the groove. The pin is extruded by the hydraulic pressure within a hydraulic chamber formed in a bottom of the hole. Moreover, the pin is biased in the direction of backward motion by a biasing force of a return spring arranged on the bottom of the hole so as to be received in the hole. Supply and discharge of the hydraulic pressure from the hydraulic chamber are ensured through an oil passage formed axially through the camshaft.

Under low rotation and light load of the engine, supply of the hydraulic pressure to the hydraulic chamber is shut off, so that the pin is received in the hole by a biasing force of the return spring. Thus, the cam is out of coupling with the camshaft to receive no torque therefrom, being retained in the non-rotation state. This brings the valve to be in non-operation, resulting, for example, in improved fuel consumption.

On the other hand, under high rotation and heavy load of the engine, the hydraulic pressure is supplied to the hydraulic chamber through the oil passage, so that the pin is extruded from the hole against a biasing force of the return spring to have an end engaged with the groove at a predetermined rotation timing where the hole correspond to the groove. Thus, the cam is coupled with the camshaft to receive torque therefrom. This actuates the valve in an open and closed way to allow, for example, improved filling efficiency of intake air, resulting in achievement of high power of the engine.

In the above system, however, since the cam and the camshaft are rotatable relative to each other as described above, problems arise such as difficult control for switching from engine low-rotation light-load operation to high-rotation heavy-load operation, i.e. from the released state to the coupled state of the cam and the camshaft, and occurrence of big hammering.

Specifically, during engine low-rotation light-load operation, coupling of the cam with the camshaft is released so that the camshaft is in rotation, but the cam is out of rotation. When passing to engine high-rotation heavy-load operation, the pin of the rotating camshaft protrudes to engage with the groove of the standing cam. Thus, the timing at which the groove corresponds to the hole is difficult to adjust, making smooth engagement of the pin with the groove very difficult. This may result in impossibility of the above switching control.

Moreover, even if the pin can engage with the groove without a hitch, torque of the camshaft acts on an edge of the groove through the pin at the instant when the pin engages with the groove, producing great hammering. This hammering may cause not only damage of the edge of the groove and the end of the pin, but abnormal wear between the groove and the pin.

SUMMARY OF THE INVENTION

It is, therefore an object of the present invention to provide a system for driving and controlling a cam for an internal combustion engine, which enables quick and smooth coupling and release of the cam from the camshaft without any occurrence of collision of component parts.

Generally, the present invention provides an internal combustion engine with a valve, comprising:

a camshaft;

a cam which actuates the valve by torque of said camshaft, said cam being movable in a radial direction of said camshaft, said cam including a lift portion which moves forward and backward in a direction of the valve;

a support mechanism which rotates said cam with said camshaft; and a first device which engages said cam with said camshaft and releases said cam from said camshaft in accordance with engine operating conditions.

One aspect of the present invention is to provide an internal combustion engine with a valve, comprising:

a camshaft;

a cam which actuates the valve by torque of said camshaft, said cam being movable in a radial direction of said camshaft, said cam including a lift portion which moves forward and backward in a direction of the valve;

a support mechanism which rotates said cam with said camshaft; and means for engaging said cam with said camshaft and releasing said cam from said camshaft in accordance with engine operating conditions.

DETAILED DESCRIPTION OF THE INVENTION

Figure 1:
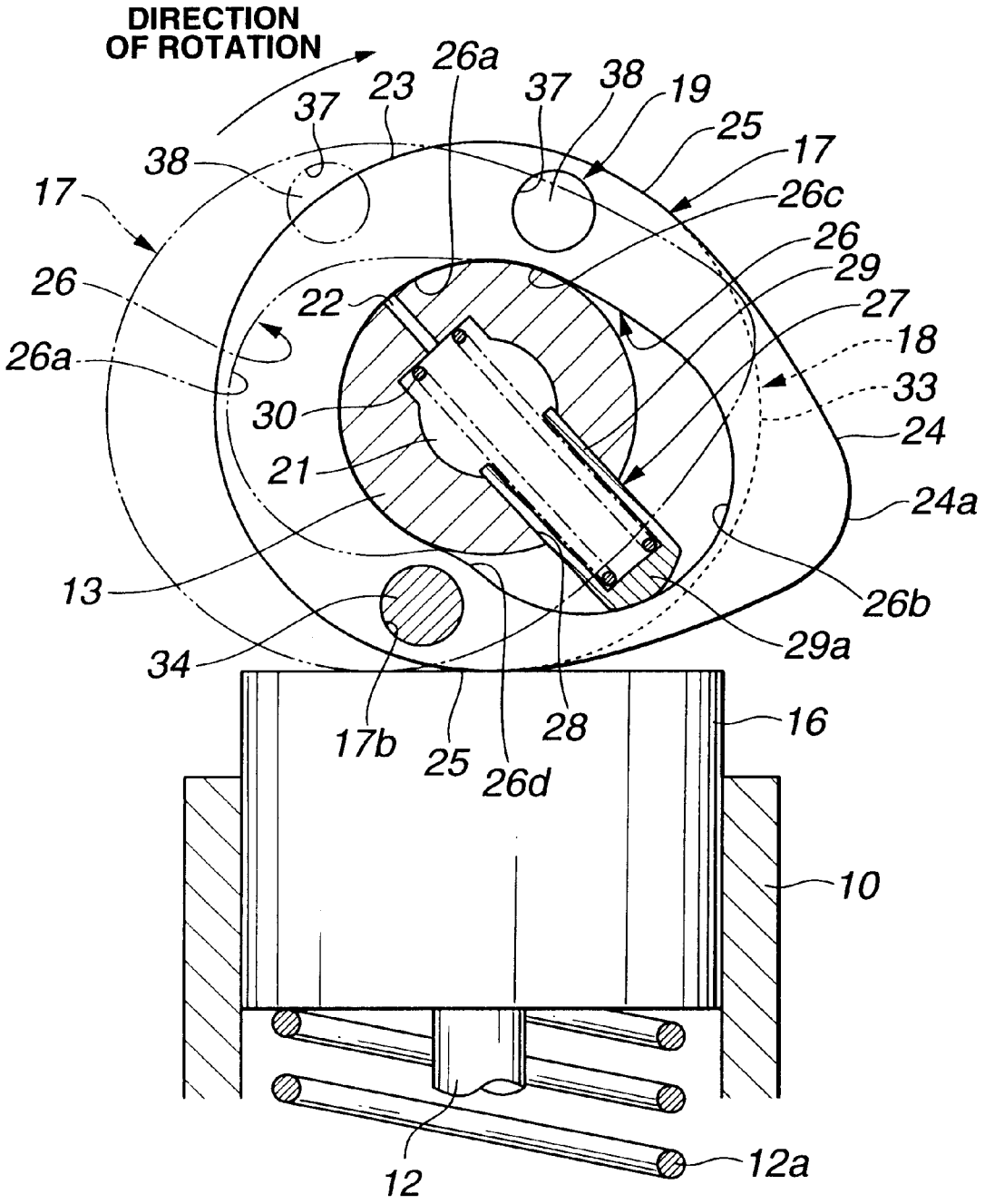
FIG. 1 is a sectional view taken along the line 1—1 in FIG. 2, showing a first embodiment of a system for driving and controlling a cam for an internal combustion engine.

Referring to the drawings, a description will be made with regard to a system for driving and controlling a cam for an internal combustion engine embodying the present invention.

Referring to FIGS. 1–5, the cam driving controlling system is applied to an internal combustion engine including two intake valves 11, 12 per cylinder at a cylinder head 10. The first intake valve 11 is opened by an ordinary stationary cam 14 secured to a camshaft 13 through a valve lifter 15, whereas the second intake valve 12 is opened by the cam driving controlling system.

Specifically, as best seen in FIG. 1, the cam driving controlling system is disposed above the cylinder head 10 and along the longitudinal direction of the engine, and comprises the camshaft 13 driven by torque transmitted from a crankshaft, a movable cam 17 arranged at the outer periphery of the camshaft 13 to be movable substantially in the radial direction of the camshaft and cooperating with a valve spring 12*a* to actuate the second intake valve 12 in an open and closed way through a lidded cylinder-shaped direct operated valve lifter 16, a support mechanism 18 arranged at the outer periphery of the camshaft 13 to support an end of the movable cam 17, and means 19 for engaging the movable cam 17 with the camshaft 13 and releasing the movable cam 17 from the camshaft 13 in accordance with the engine operating conditions.

Figure 2:
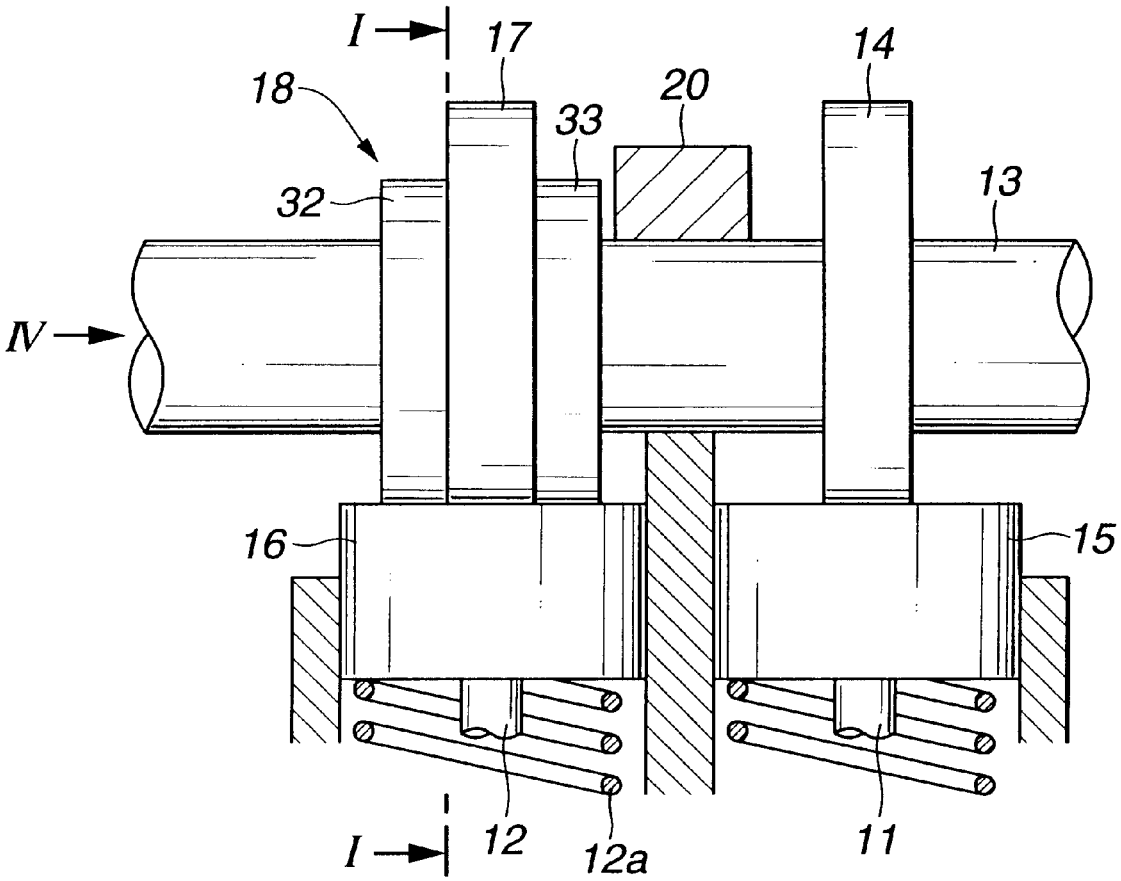
FIG. 2 is a side view showing the system.

As shown in FIG. 2, the camshaft 13 is supported by a bearing 20 arranged at an upper end of the cylinder head 10 to be rotatable clockwise as viewed in FIG. 1. An oil passage 21 is axially formed through the camshaft 13, to which the hydraulic pressure is supplied from a hydraulic circuit as will be described later. A small hole 22 is radially formed in the camshaft 13 in the position corresponding to the movable cam 17 so as to communicate with the oil passage 21.

Figure 5:
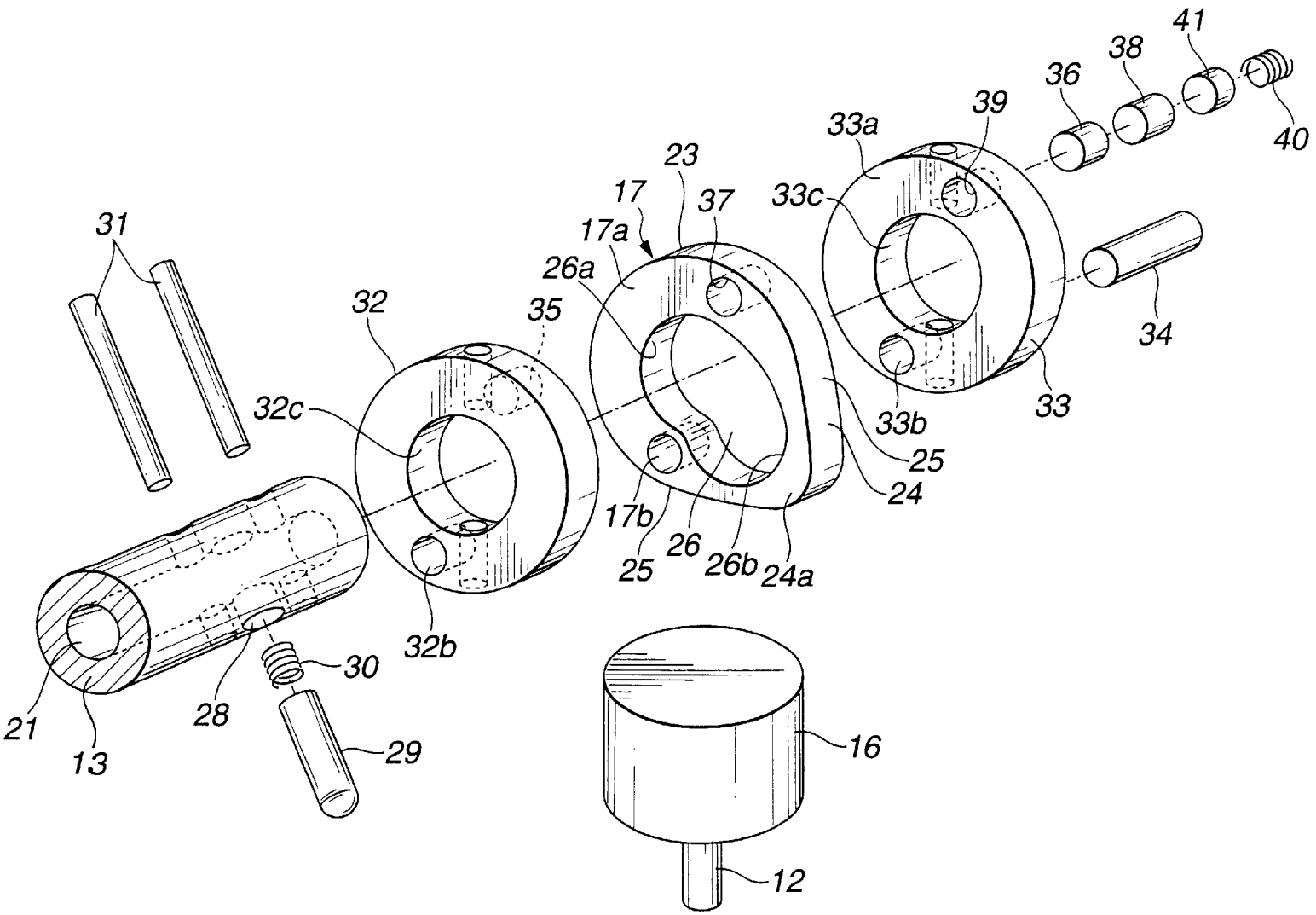
FIG. 5 is an exploded perspective view showing the system.
Figure 10:
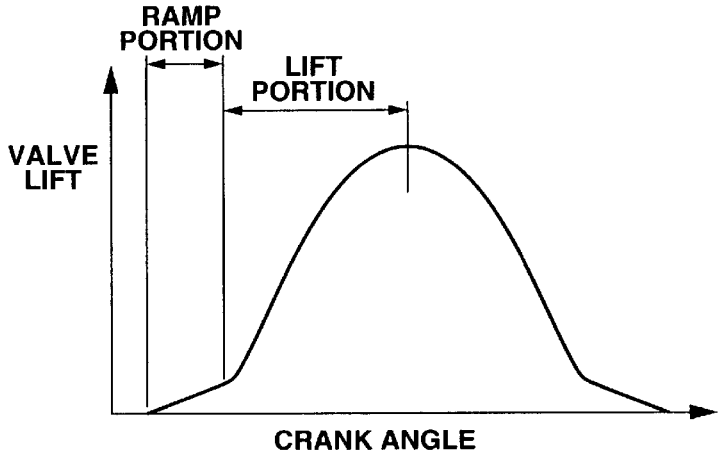
FIG. 10 is a graph illustrating lift characteristics of a movable cam in the first embodiment.

As best seen in FIG. 5, the movable cam 17 comprises a base circle portion 23 with a raindrop-shaped or roughly circular profile, a cam lift portion 24 protruding from an end of the base circle portion 23, a ramp portion 25 located between the base circle portion 23 and the cam lift portion 24, which rotate to come in slide contact with roughly the center of the top face of the valve lifter 16. The lift characteristics of the movable cam 17 are as shown in FIG. 10.

A slider or center opening 26 is formed through the center of the movable cam 17 to receive the camshaft 13. As best seen in FIG. 1, the slider opening 26 is shaped like a cocoon substantially along the radial direction of the camshaft 13, and has one circular end 26*a* arranged in the center of the base circle portion 23 and another circular end 26*b* arranged on the side of a top 24*a* of the cam lift portion 24. One end face 26*c* of the slider opening 26 between the two ends 26*a*, 26*b* includes a smooth circular continuous face, whereas another end face 26*d* facing the end face 26*c* includes a soft protrusion.

The movable cam 17 is movably arranged so that the cam lift portion 24 can move forward by biasing means 27 through the slider opening 26. Specifically, as shown in FIG. 1, the biasing means 27 comprise a plunger hole 28 substantially radially formed in the camshaft 13 to correspond to the second intake valve 12, a plunger 29 slidably arranged in the plunger hole 28, and a return spring 30 for biasing the plunger 29 toward an inner peripheral surface of the slider opening 26.

The plunger hole 28 is formed so that the bottom traverses the oil passage 21. The plunger 29, which moves slidably in the plunger hole 28, is formed like a lidded cylinder, and has a head 29*a* with a spherical head face directed to the inner peripheral surface of the slider opening 26. The return spring 30 has one end resiliently held by the bottom of the plunger hole 28 and another end resiliently held by the bottom of a cavity of the plunger 29. The coil length of the return spring 30 is set so that when the cam lift portion 24 of the movable cam 17 moves forward maximally, a biasing force is approximately zero.

Figure 3:
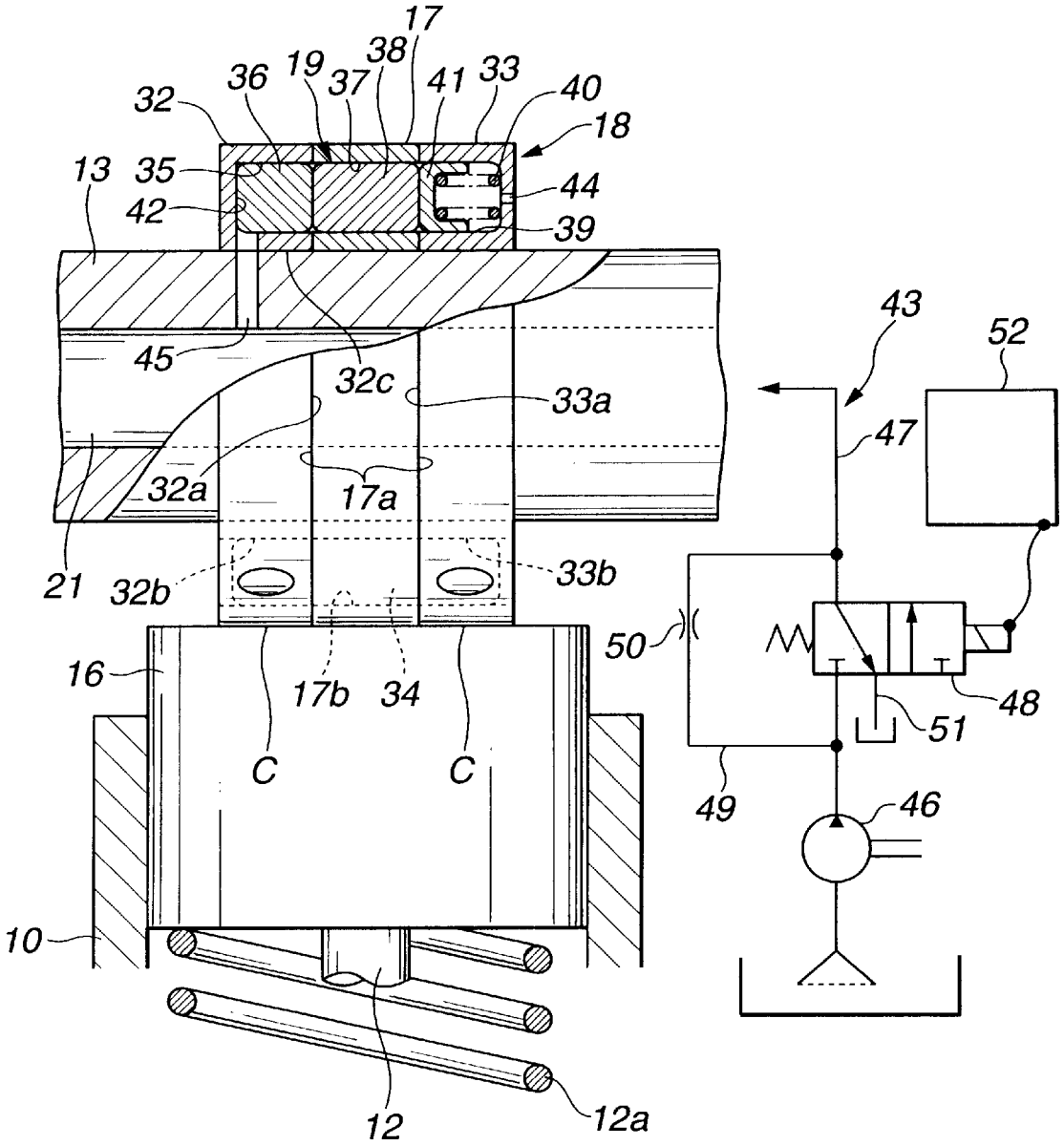
FIG. 3 is an enlarged fragmentary view, partly in section, showing the system.
Figure 4:
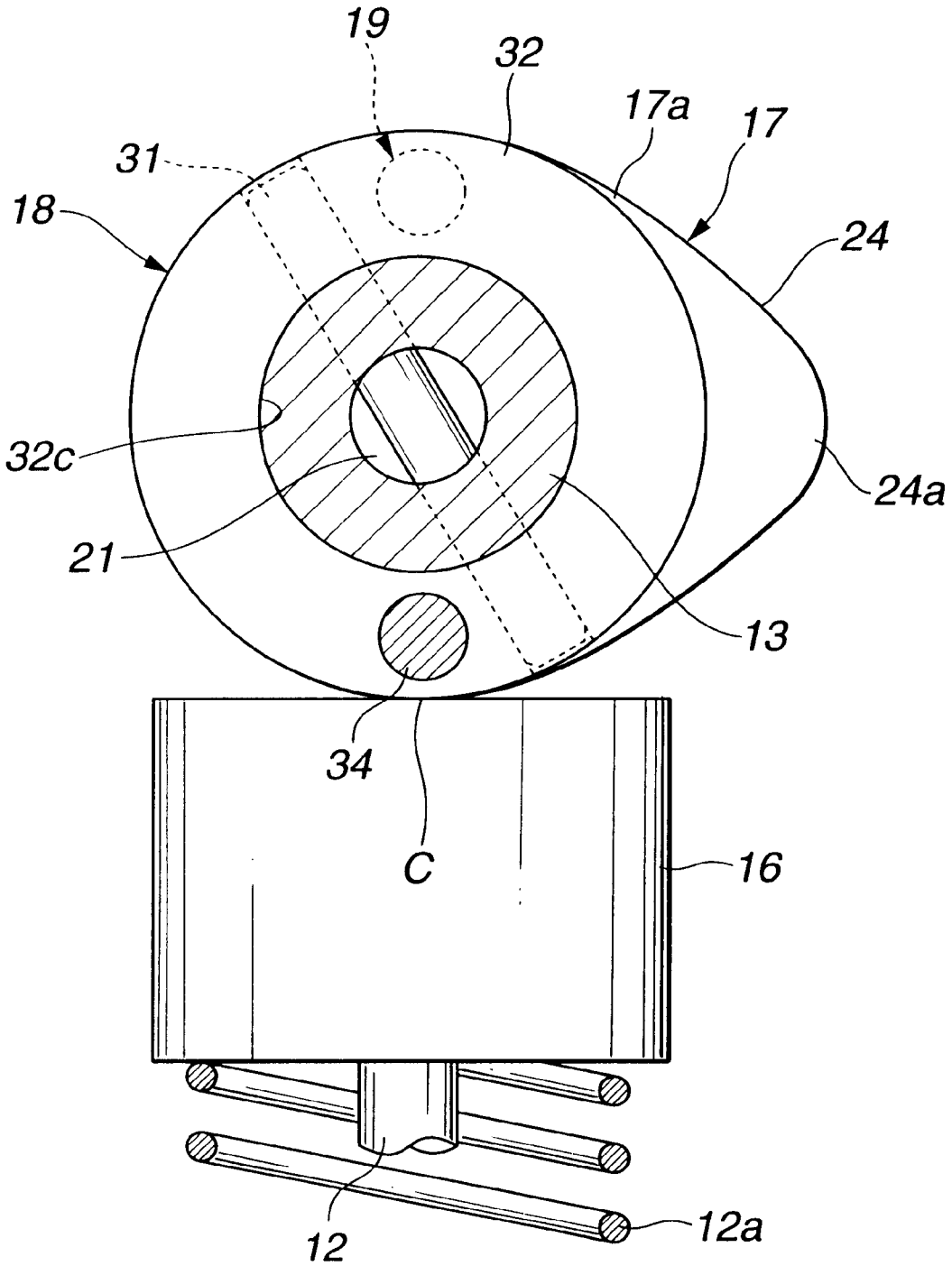
FIG. 4 is a drawing as viewed from arrow IV in FIG. 2.

As best seen in FIGS. 3–4, the support mechanism 18 comprises a pair of flanges 32, 33 disposed on both side faces 17*a* of the movable cam 17 and secured to the camshaft 13 by respective securing pins 31 arranged diametrally through the flanges and the camshaft, and a support pin 34 arranged through the flanges 32, 33 and the movable cam 17 to support the movable cam 17.

Each of the flanges 32, 33 is shaped roughly annularly with the outer diameter set to be substantially the same as that of the base circle portion 23 of the movable cam 17, and has in the center an engagement opening 32*c*, 33*c* engaged with the camshaft 13. Facing inside faces 32*a*, 33*a* of the flanges 32, 33 are in slide contact with the side faces 17*a* of the movable cam 17. Moreover, when the cam lift portion 24 of the movable cam 17 moves backward, the outer peripheral surfaces of the flanges 32, 33 face the top face of the valve lifter 16 with a small clearance C.

The support pin 34 are arranged through pin holes 32*b*, 33*b* formed through the respective outer peripheries of the flanges 32, 33 and a through hole 17*b* formed through the protrudent end face 26*d* of the slider opening 26 of the movable cam 17. The support pin 34 is press fit into the pin holes 32*b*, 33*b*, and is slidably fit through the through hole 17*b* to secure free oscillation of the movable cam 17.

As shown in FIGS. 1 and 3, the engaging releasing means 19 comprise a bottomed receiving hole 35 formed in the flange 32 to extend axially from the inside face 32*a* to the outside face, an engaging piston 36 slidably arranged to allow motion from the inside of the receiving hole 35 to the outside, an engagement hole 37 formed axially through the movable cam 17 in the 180° circumferential position with respect to the through hole 17*b* and facing the receiving hole 35 in a predefined base circle area of the movable cam 17, a pressing piston 38 slidably arranged in the engagement hole 37 and having one end face facing one end face of the engaging piston 36 as required, a biasing piston 41 arranged in a bottomed holding hole 39 formed in the flange 33 to correspond to the receiving hole 35 and for moving backward the engaging piston 36 by a biasing force of a spring member 40 through the pressing piston 38, and a hydraulic circuit 43 for selectively supplying and discharging the hydraulic pressure from a hydraulic chamber 42 formed in the bottom of the receiving hole 35. The pressing piston 38, the biasing piston 41, and the spring member 40 constitute a biasing mechanism. A small-diameter air vent hole 44 is formed through a bottom wall of the holding hole 39 to secure free slide motion of the biasing piston 41.

The axial length of the engaging piston 36 and pressing piston 38 is set to be substantially the same as that of the corresponding receiving hole 35 and engagement hole 37, whereas the axial length of the biasing piston 41 is set to be smaller than that of the holding hole 39. The engagement hole 37 is positioned so that when the cam lift portion 24 of the movable cam 17 moves backward maximally, both ends of the biasing piston 38 face the corresponding inside faces 32*a*, 33*a* of the flanges 32, 33.

As shown in FIG. 3, the hydraulic circuit 43 comprises an oil hole 45 formed radially in the camshaft 13 to communicate with the hydraulic chamber 42 and the oil passage 21, a hydraulic-pressure supply and discharge passage 47 having one end communicating with the oil passage 21 and another end communicating with an oil pump 46, a bi-directional solenoid valve 48 interposed between the oil pump 46 and the oil passage 21, and an orifice 50 arranged with a bypass passage 49 for bypassing the solenoid valve 48.

The solenoid valve 48 is connected to a drain passage 51 which communicates with the oil passage 21 as required, and ensures switching between the oil passage 21 and the drain passage 51 by a microcomputer-based controller 52. The controller 52 provides a control signal to the solenoid valve 48 in accordance with the engine operating conditions detected by various sensors such as a crank angle sensor, airflow meter, coolant temperature sensor and throttle-valve opening sensor, not shown.

Operation of the first embodiment will be described. Under low rotation and light load of the engine, the solenoid valve 48 shuts off the upstream side of the supply and discharge passage 47 in accordance with a control signal of the controller 52, and ensures communication between the supply and discharge passage 47 and the drain passage 51, thus supplying no hydraulic pressure to the hydraulic chamber 42. As a result, the engaging piston 36, the pressing piston 38, and the biasing piston 41 are received in the respective holes 35, 37, 38 as shown in FIG. 3, being retained in the state of releasing engagement of the movable cam 17 with the camshaft 13.

Figure 6:
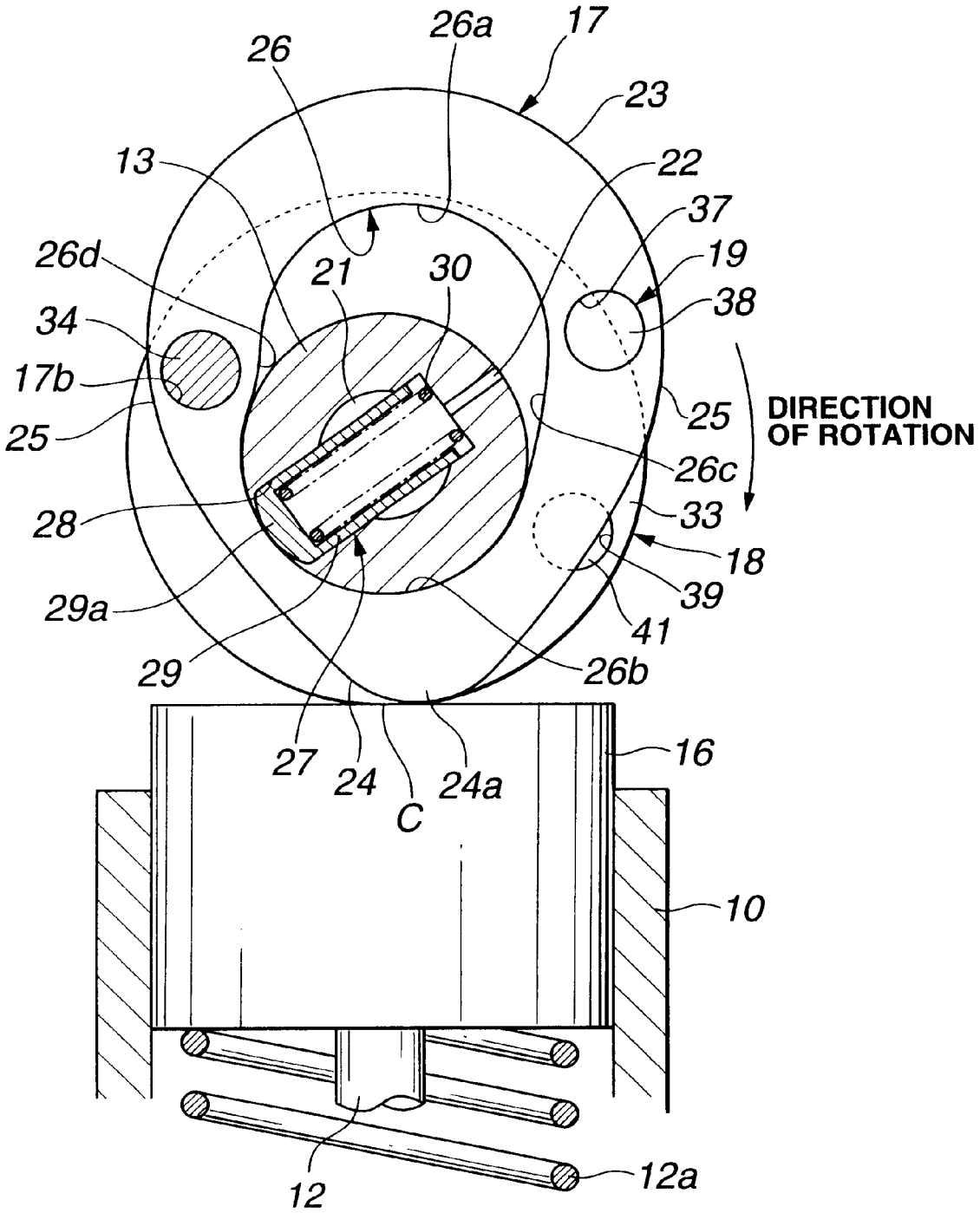
FIG. 6 is a view similar to FIG. 1, explaining operation of the first embodiment.

Therefore, referring to FIGS. 1 and 6–8, when the flanges 32, 33 rotate in synchronism with rotation of the camshaft 13, the movable cam 17 also rotates in synchronism with the camshaft through the support pin 34. When the outer peripheral surface of the movable cam 17 comes in slide contact with the top face of the valve lifter 16 as shown in FIG. 1, and that subsequent to the base circle portion 23 and the ramp portion 25, the cam lift portion 24 reaches the top face of the valve lifter 16, a biasing force of the valve spring 12*a* acts on the cam lift portion 24 as shown in FIG. 6. This pushes back the plunger 29 against a biasing force of the return spring 30, so that the movable cam 17 swings to the another end 26*b* through the slider opening 26 with the support pin 34 as the fulcrum, i.e. the cam lift portion 24 moves backward maximally up to substantially the same level as that of outer peripheral edges of the flanges 32, 33, engaging the another end 26*b* with the camshaft 13.

Figure 7:
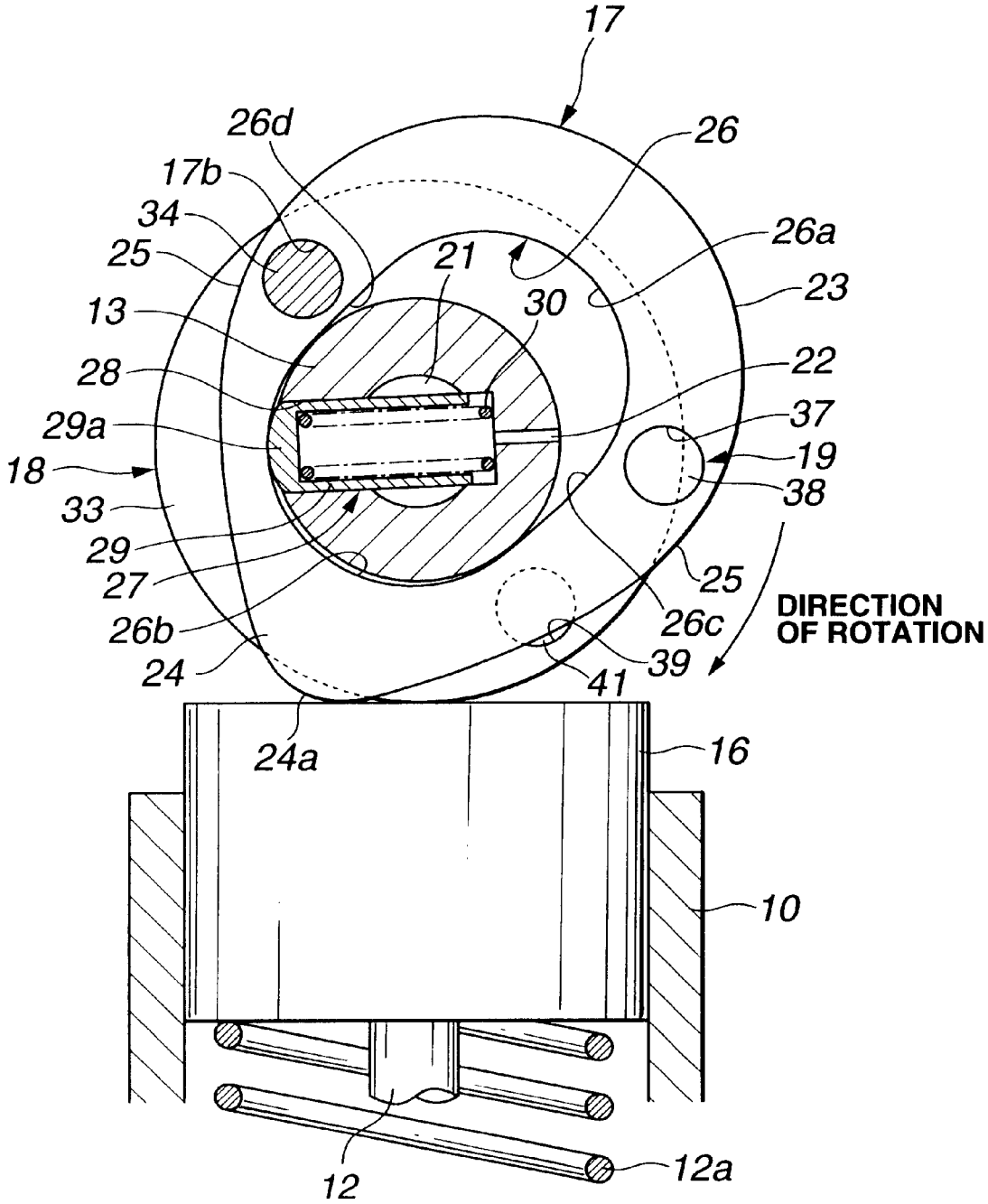
FIG. 7 is a view similar to FIG. 6, explaining operation of the first embodiment.
Figure 8:
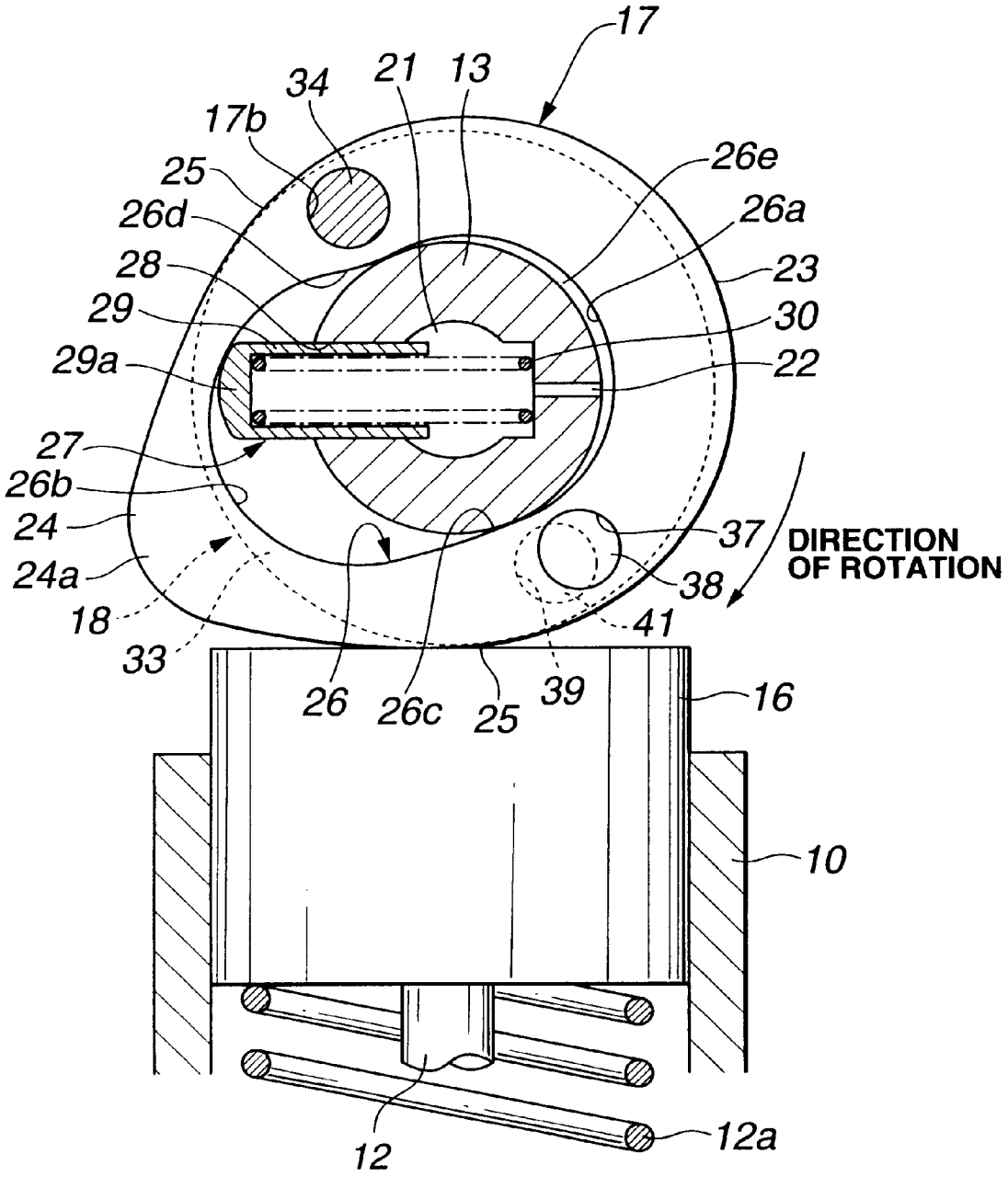
FIG. 8 is a view similar to FIG. 7, explaining operation of the first embodiment.

As shown in FIGS. 7–8, when the movable cam 17 rotates further to involve the other ramp portion 25, the engagement position of the movable cam 17 with respect to the camshaft 13 passes from the another end 26*b* of the slider opening 26 to the one end 26*a*, so that the cam lift portion 24 moves forward by a biasing force of the return spring 30 through the plunger 29. When further rotation of the movable cam 17 is carried out to involve the base circle portion 23 as shown in FIG. 1, the cam lift portion 24 moves forward maximally.

Specifically, in this engine operating area, though rotating in synchronism with the camshaft 13, the movable cam 17, together with the flanges 32, 33, comes in slide contact with the top face of the valve lifter 16 in the base circle area, carrying out no lift operation to the second intake valve 12. Therefore, the first intake valve 11 is lifted by the stationary cam 14 for opening and closing operation, whereas the second intake valve 12 is closed by a biasing force of the valve spring 12*a*, being retained in the valve stop state so called. This produces strong swirl in intake air flowing into the cylinder to accelerate combustion, enabling improved fuel consumption.

Moreover, even when the solenoid valve 48 shuts off supply of the hydraulic pressure to the hydraulic chamber 42 as described above, the hydraulic pressure discharged from the oil pump 46 is partly slightly supplied to the hydraulic chamber 42, etc. via the orifice 50 of the bypass passage 49, the oil passage 21, and the oil hole 45 for lubrication of each member. Additionally, as shown in FIG. 8, the hydraulic pressure is also supplied from the small hole 22 to a crescent clearance 26*e* formed between the outer peripheral surface of the camshaft 13 and the inner peripheral surface of the one end 26*a* of the slider opening 26, which restrains sudden protrusion of the cam lift portion 24 of the movable cam 17 when passing from the ramp portion 25 to the cam lift portion 24 which moves forward maximally. That is, this slight hydraulic pressure functions as a damper. This prevents a click phenomenon so called during passage from the cam lift portion 24 to the ramp portion 25, resulting in prevented occurrence of hammering and wear between the top face of the valve lifter 16 and the outer peripheral surface of the movable cam 17 or between the outer peripheral surface of the camshaft 13 and the inner peripheral surface of one end of the slider opening 26.

Figure 9:
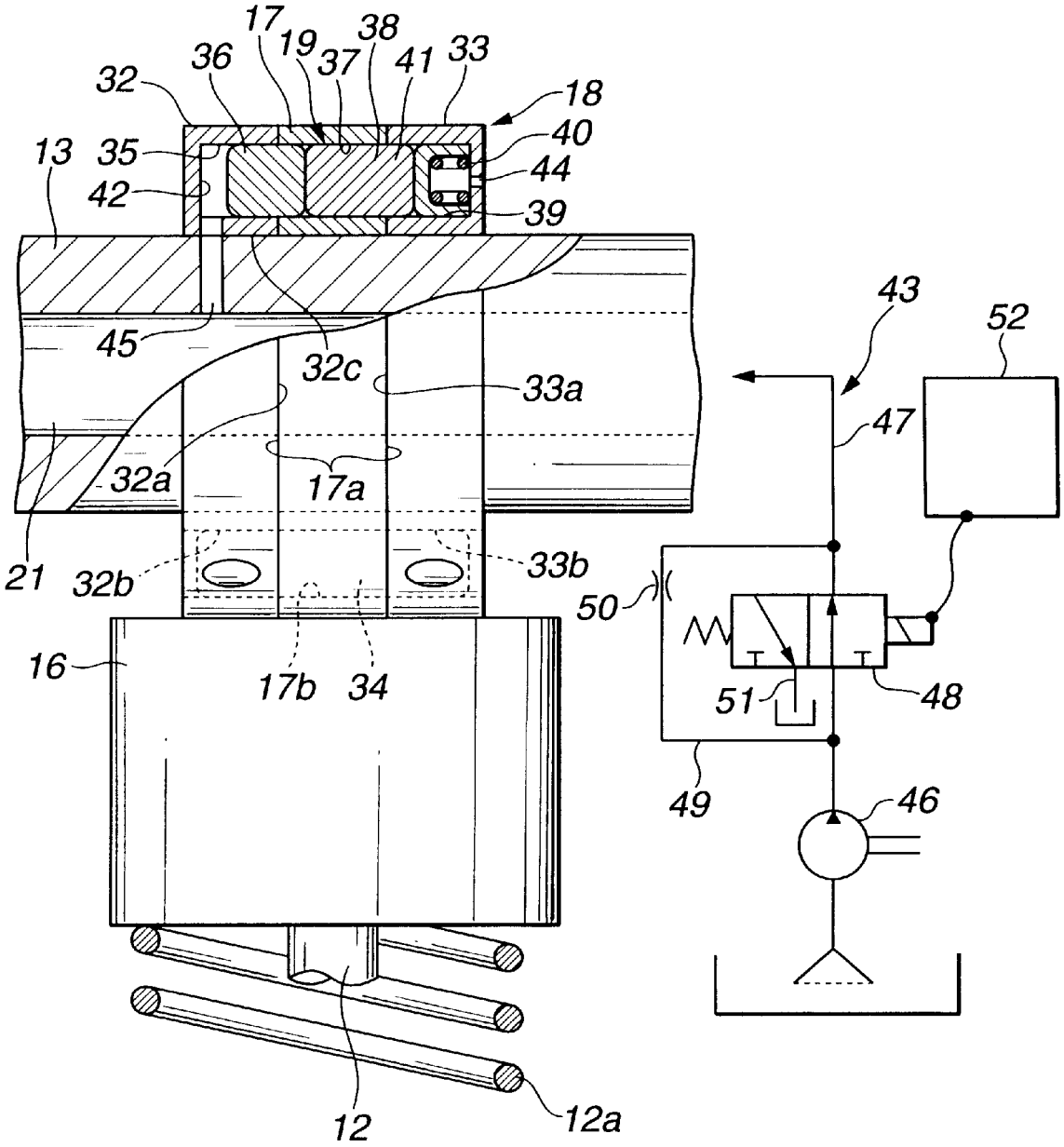
FIG. 9 is a view similar to FIG. 3, explaining operation of engaging releasing means in the first embodiment.

On the other hand, under high rotation and heavy load of the engine, for example, the solenoid valve 48 is switched in accordance with a control signal of the controller 52 to shut off the drain passage 51 and ensure communication between the upstream and downstream sides of the supply and discharge passage 47. As a result, the hydraulic pressure discharged from the oil pump 46 is supplied to the hydraulic chamber 42 via the supply and discharge passage 47, the oil passage 21, and the oil hole 45. Thus, referring to FIG. 9, when the movable cam 17 rotates to have the base circle portion 23 facing the top face of the valve lifter 16, i.e. the receiving hole 35, the engagement hole 37, and the holding hole 39 are aligned in the base circle area, the head of the engaging piston 36 protrudes by the high hydraulic pressure within the hydraulic chamber 42 against a biasing force of the spring member 40 so as to push back the pressing piston 38 and the biasing piston 41, engaging with the engagement hole 37. Simultaneously, another end of the pressing piston 38 also engages with the holding hole 39. Thus, with the cam lift portion 24 moving forward maximally, the movable cam 17 engages with the flanges 32, 33 to be integrated with the camshaft 13.

As a result, in the same way as the stationary cam 14, the movable cam 17 can exert a cam lift function with rotation of the camshaft 13 to lift the second intake valve 12 as shown in FIG. 10. This improves the filling efficiency of intake air due to opening and closing operation of the two intake valves 11, 12, enabling increased engine output.

In such a way, according to the first embodiment, the movable cam 17 is constructed to always rotate in synchronism with the camshaft 13 through the support pin 34, and engagement and release of the movable cam 17 from the camshaft 13 are carried out by the engaging releasing means 19 during rotation of the two, obtaining quick and sure engagement and release, enabling prevented occurrence of collision of component parts.

Moreover, engagement of the engaging releasing means 19, i.e. engagement of the engaging piston 36 and the pressing piston 38 with the engagement hole 37 and the holding hole 39, is carried out during rotation of the camshaft 13 and the movable cam 17 and in the base circle area of the movable cam 17, allowing a sufficient engageable time, resulting in stable and surer engagement even during high rotation.

Further, according to the first embodiment, the biasing means 27 are arranged in the direction of forward motion of the cam lift portion 24 of the movable cam 17, so that when the cam lift portion 24 is pressed by a biasing force of the valve spring 12*a*, backward motion of the movable cam 17 is readily carried out in its entirety through the cam lift portion 24.

Moreover, as described above, the engagement hole 37 is positioned so that when the cam lift portion 24 moves backward maximally, both ends of the biasing piston 38 face the corresponding inside faces 32*a*, 33*a* of the flanges 32, 33, so that with engagement of the movable cam 17 with the camshaft 17 being released, both ends of the biasing piston 38 always face the inside faces 32*a*, 33*a* of the flanges 32, 33 in any moving position of the movable cam 17, having no accidental disengagement of the biasing piston 38 from the engagement hole 37. Likewise, the heads of the engaging piston 36 and the biasing piston 41 always face the side faces 17*a* of the movable cam 17, having no accidental disengagement of the engaging piston 36 and the biasing piston 41.

Figure 11:
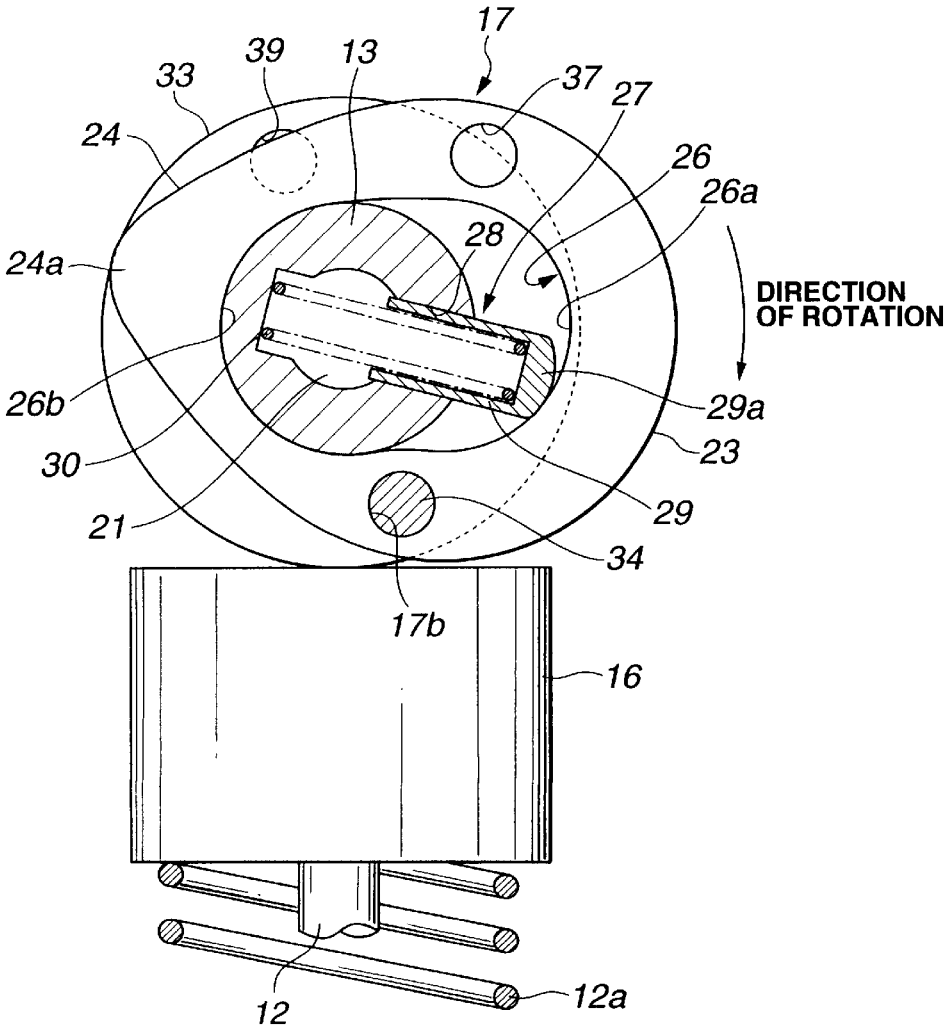
FIG. 11 is a view similar to FIG. 8, showing a second embodiment of the present invention.

FIG. 11 shows a second embodiment of the present invention wherein the basing means 27 are arranged with respect to the movable cam 17 in the opposite way to in the first embodiment. Specifically, the plunger hole 28 is formed in the inner peripheral surface of the one end 26*a* of the slider opening 26 of the movable cam 17 so that the head 29*a* of the plunger 29 abuts on the inner peripheral surface of the one end 26*a*.

According to the second embodiment, when the movable cam 17 rotates to have the base circle portion 23 coming in contact with the valve lifter 16, the base circle portion 23 is forcibly pressed to the same level as that of the outer diameters of the flanges 32, 33, i.e. on the top face of the valve lifter 16, by the plunger 29 and the return spring 30. This enables accurate alignment of the receiving hole 35, the engagement hole 37, and the holding hole 39 in the base circle area, obtaining sure and easy engagement of the engaging piston 36 and the pressing piston 38 with the holes 35, 37, 39. This results in excellent coupling of the movable cam 17 with the camshaft 13.

Figure 12:
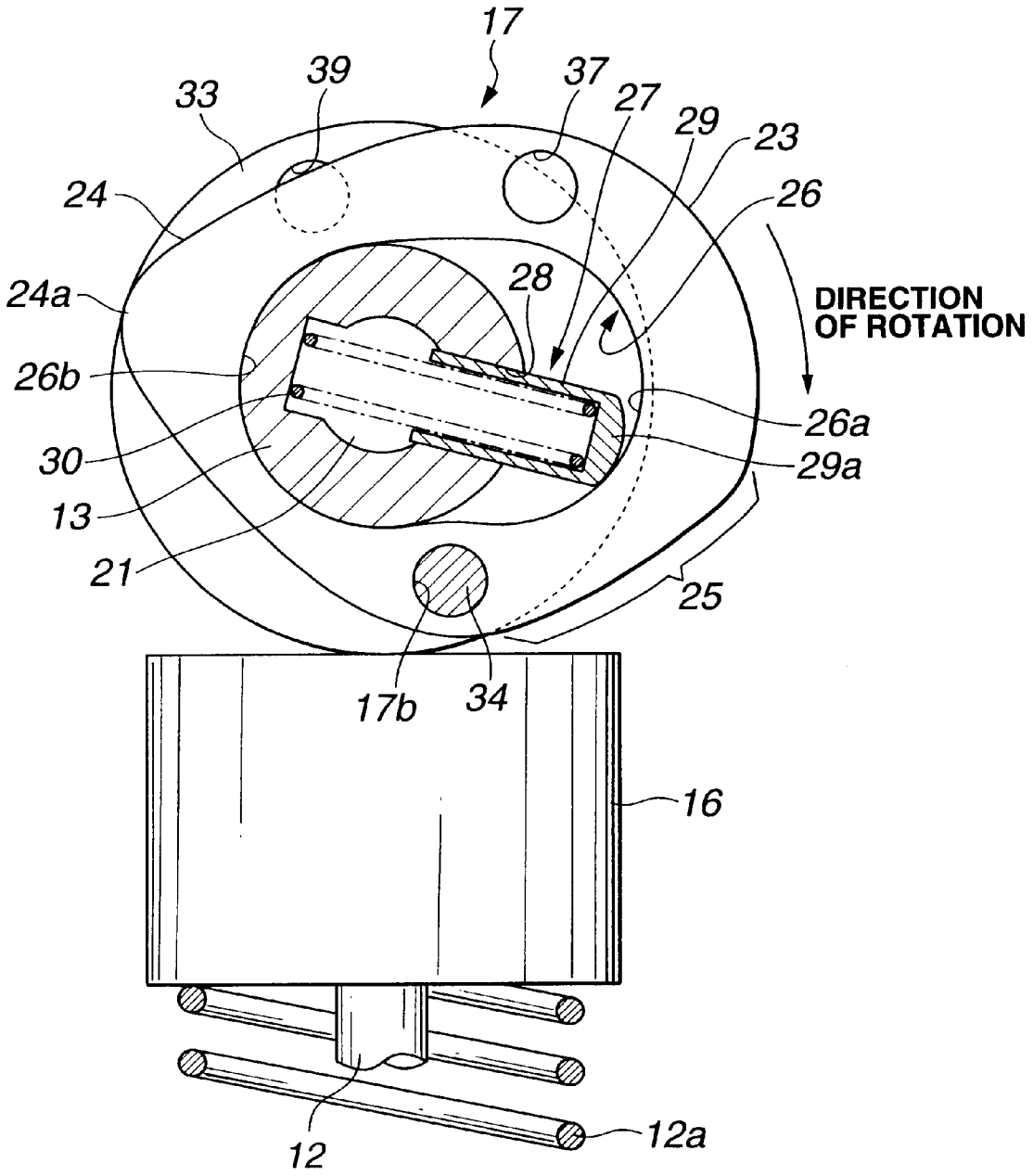
FIG. 12 is a view similar to FIG. 11, showing a third embodiment of the present invention.

FIG. 12 shows a third embodiment of the present invention which is substantially the same as the second embodiment except that the cam profile of the movable cam 17 is changed by cutting the outer surface of the ramp portion 25 between the base circle portion 23 and the cam lift portion 24 and on the forward side as viewed in the direction of rotation of the movable cam 17.

According to the third embodiment, with engagement of the movable cam 17 released, when the movable cam 17 rotates to pass from the cam lift portion 24 to the ramp portion 25, start of slide motion or oscillation of the slider opening 26 of the movable cam 17 can smoothly be carried out to reduce re-acceleration of oscillation thereof. This enables not only a reduction in hammering upon start of contact of the outer peripheral surface of the movable cam 17 with the top face of the valve lifter 16, but a prevention of collision of the inner peripheral surface of the slider opening 26 with the outer peripheral surface of the camshaft 13.

Figure 13:
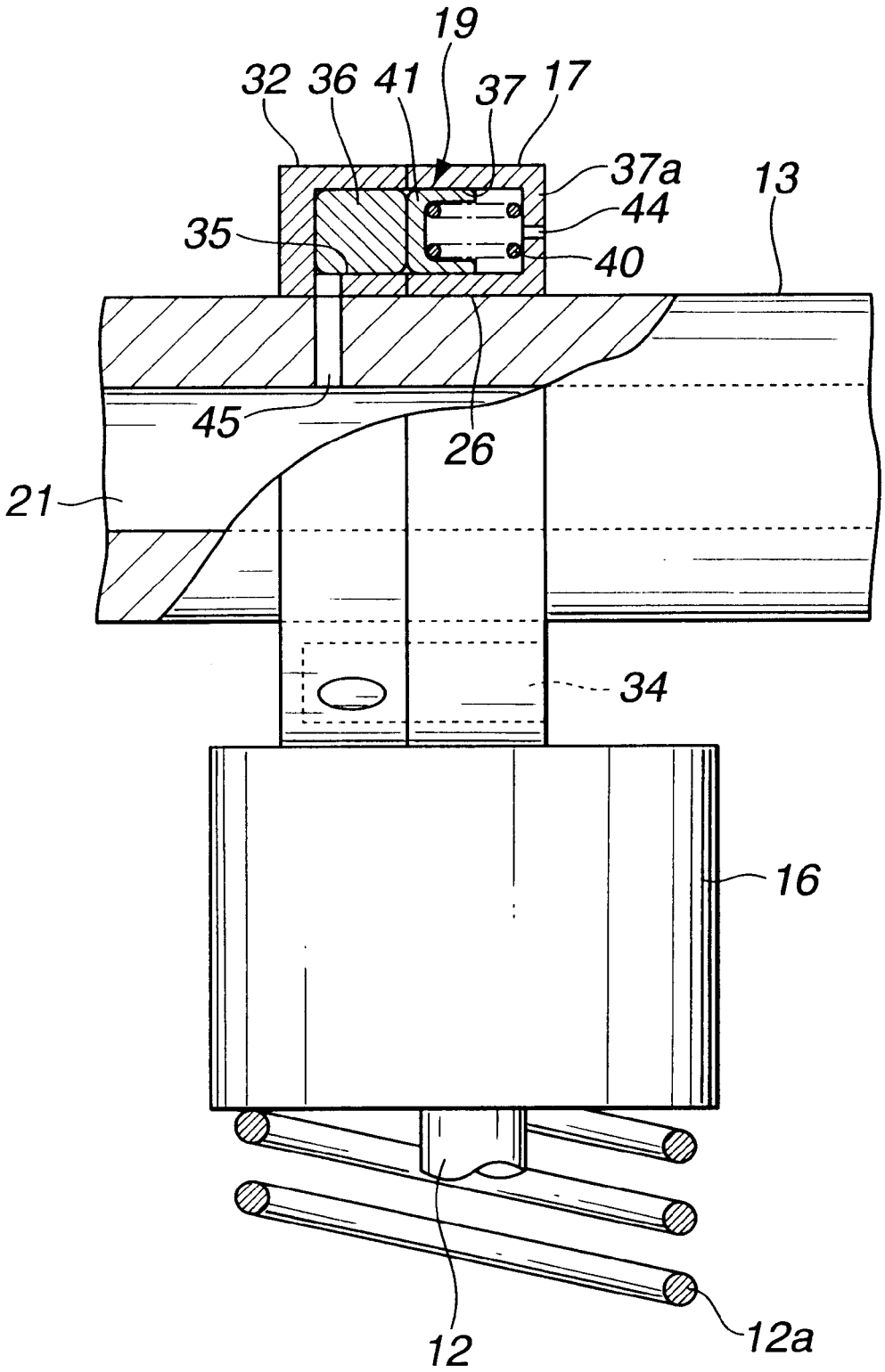
FIG. 13 is a view similar to FIG. 9, showing a fourth embodiment of the present invention.

FIG. 13 shows a fourth embodiment of the present invention wherein one of the flanges 32, 33 of the camshaft 13 is eliminated, and a slight change is carried out in the structure of the engaging releasing means 19 accordingly. Specifically, the engaging releasing means 19 comprise the engagement hole 37 of the movable cam 17 formed as a bottomed engagement hole facing the receiving hole 35 of the flange 32, the biasing piston 41 arranged in the engagement hole 37, and the spring member 40 for biasing the biasing piston 41 toward the engaging piston 36. In the same way as in the first embodiment, the movable cam 17 is swingably supported by the support pin 34 press fit into the flange 32. The air vent hole 44 is formed through the bottom wall 37*a* of the engagement hole 37 to secure free slide motion of the biasing piston 41.

According to the fourth embodiment, the apparatus can be simplified in structure and reduced in weight. Moreover, the width of the movable cam 17 can be enlarged, obtaining stable slide performance of the movable cam 17 with respect to the top face of the valve lifter 16.

Figure 14:
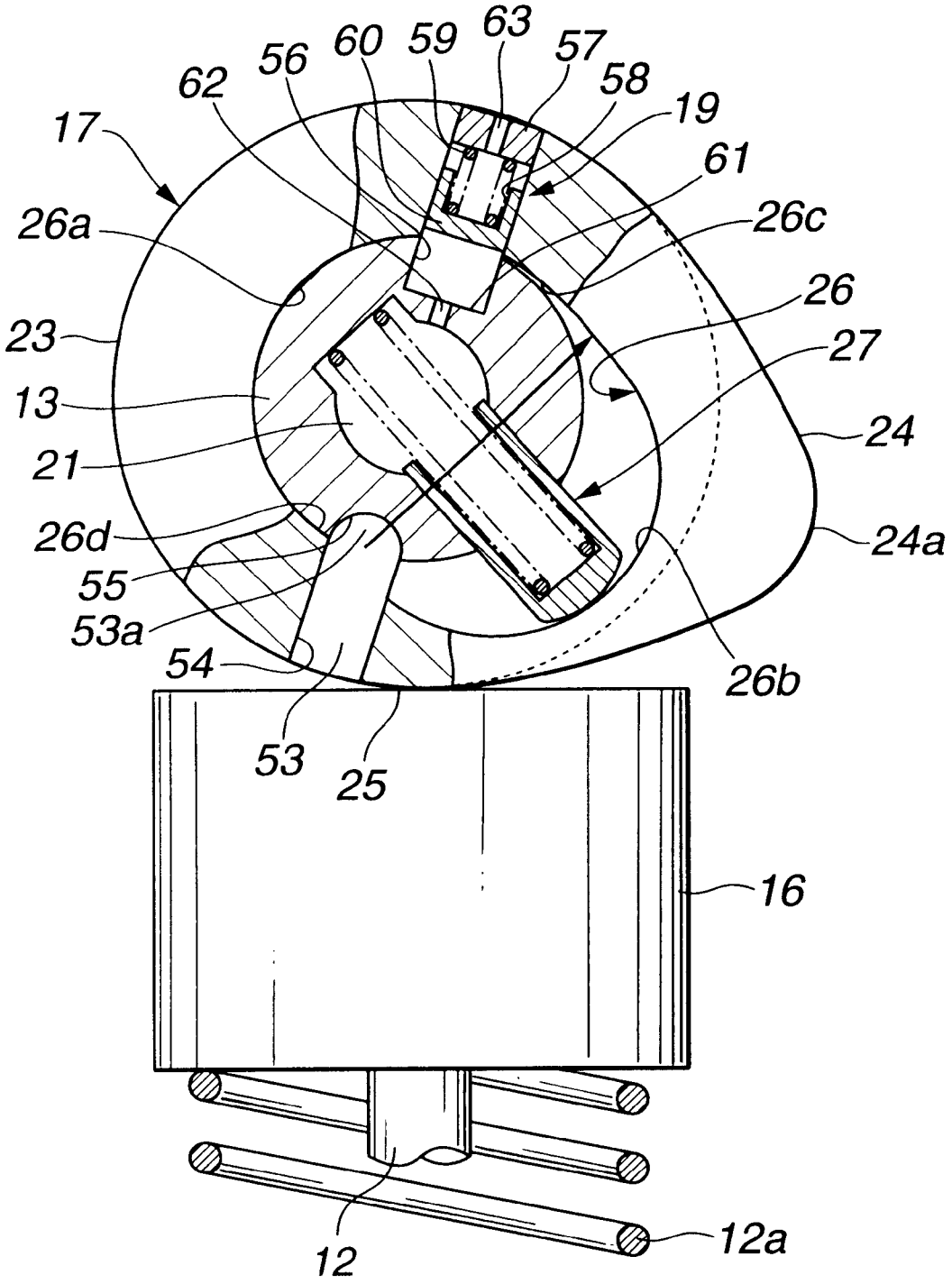
FIG. 14 is a view similar to FIG. 12, showing a fifth embodiment of the present invention.

FIG. 14 shows a fifth embodiment of the present invention wherein the two flanges 32, 33 of the camshaft 13 are eliminated, and the movable cam 17 is used solely. The movable cam 17, which has fundamentally the same structure as that in the first embodiment, is supported to the camshaft 13 through a pivot pin or support mechanism 53. The engaging releasing means 19 are arranged in the radial direction of the movable 17 and the camshaft 13.

Specifically, the pivot pin 53 has a head 53*a* shaped spherically, and is press fit into a press-fit hole 54 radially formed through the movable cam 17 from the outer peripheral surface to the inner peripheral surface so that the head 53*a* is slidably engaged with a spherical groove 55 formed in the outer peripheral surface of the camshaft 13. Thus, the movable cam 17 is supported to the camshaft 13 through the slider opening 26 to be swingable about the head 53*a* of the pivot pin 53 and rotatable in synchronism with the camshaft 13. Since the movable cam 17 is supported through the pivot pin 53, its oscillation trajectory slightly differs from that in the first embodiment, causing a different curvature of the one end face 26*c* of the slider opening 26, particularly about the head 53*a* of the pivot pin 53.

The engaging releasing means 19 comprise a receiving hole 56 radially formed in the outer peripheral surface of the camshaft 13 to correspond to the pivot pin 53, a holding hole 58 radially formed in the inner peripheral surface of the base circle portion 23 of the movable cam 17 to correspond to the receiving hole 56 as required and having an end cap 57 press fit in the outer end bottom, and an engaging piston 60 slidably arranged in the holding hole 58 and biased toward the receiving hole 56 by a spring member 59. The hydraulic circuit 43 supplies and discharges the hydraulic pressure from a hydraulic chamber 61 in the bottom of the receiving hole 56 through an oil hole 62 of the camshaft 13 and the oil passage 21. An air vent hole 63 is arranged through the end cap 57. The basing means 27 are the same in structure as in the first embodiment.

According to the fifth embodiment, under low rotation and light load of the engine, the hydraulic pressure is supplied to the hydraulic chamber 61 by the solenoid valve 48, not shown, so that the engaging piston 60 moves backward against a biasing force of the spring member 59 to be held in the holding hole 58. This releases engagement of the movable cam 17 with the camshaft 13, so that the movable cam can swing about the pivot pin 53 through the slider opening 26 to put the second intake valve 12 in the valve stop state.

On the other hand, under high rotation and heavy load of the engine, supply of the hydraulic pressure to the hydraulic chamber 61 is shut off by the solenoid valve 48. And when the receiving hole 56 and the holding hole 58 are aligned in the base circle area where the cam lift portion 24 of the movable cam 17 moves forward maximally, the engaging piston 60 protrudes into the receiving hole 56 to couple the movable cam 17 with the camshaft 17 for unitary rotation. This releases valve stop of the second intake valve 12 to obtain opening and closing operation of the two intake valves 11, 12.

Particularly, according to the fifth embodiment, elimination of the flanges 32, 33 allows not only a reduction in weight of the entire apparatus, but a prevention of occurrence of unequal wear of the outer peripheral surface of the movable cam 17 due to no cantilevered support of the movable cam 17 by the single flange 32 as in the third embodiment.

Figure 15:
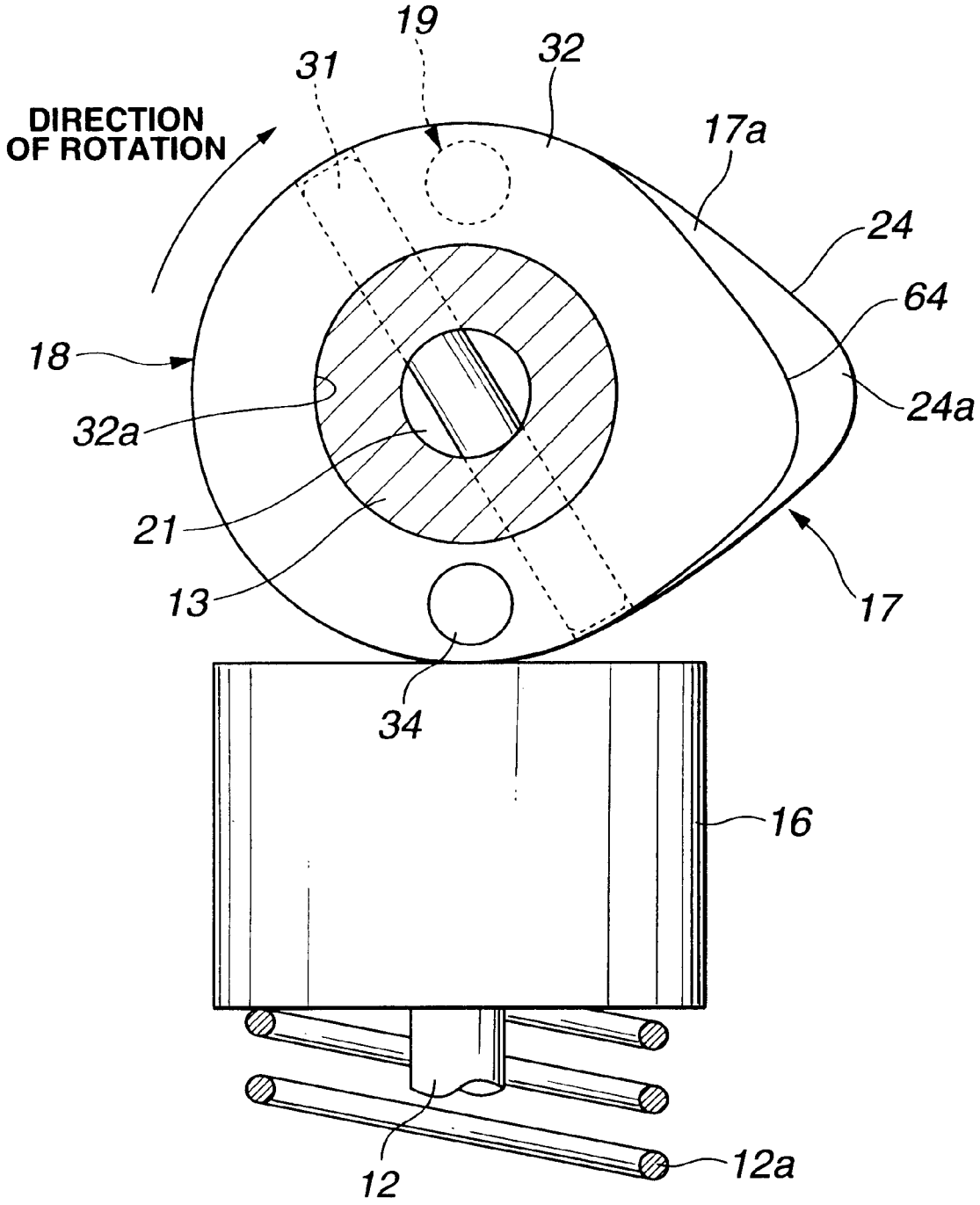
FIG. 15 is a view similar to FIG. 14, showing a sixth embodiment of the present invention.

FIG. 15 shows a sixth embodiment of the present invention wherein at least one of the flanges 32, 33 disposed on both side faces of the movable cam 17 in the first to third embodiments serves as a low-speed cam. Specifically, the cam lift portion 24 of the movable cam 17 is formed higher to have a cam profile set for high speed, whereas a second cam lift portion 64 lower than the first cam lift portion 24 is formed at the outer periphery of the flange 32 to have a cam profile set for low speed.

Under low rotation and light lord of the engine, the movable cam 17 swings free, so that when reaching the top face of the valve lifter 16, the first cam lift portion 24 moves backward up to the same level as that of the second cam lift portion 64 of the flange 32. Thus, in this operation area, without being stopped, the second intake valve 12 is actuated in an open and closed way in accordance with the lift characteristics of the second cam lift portion 64 having low valve lift as illustrated by chain line in FIG. 16. This cannot provide an improvement in fuel consumption compared with the valve stop state, but improved combustion, stable engine rotation, and high torque due to generation of swirl in the cylinder.

Figure 16:
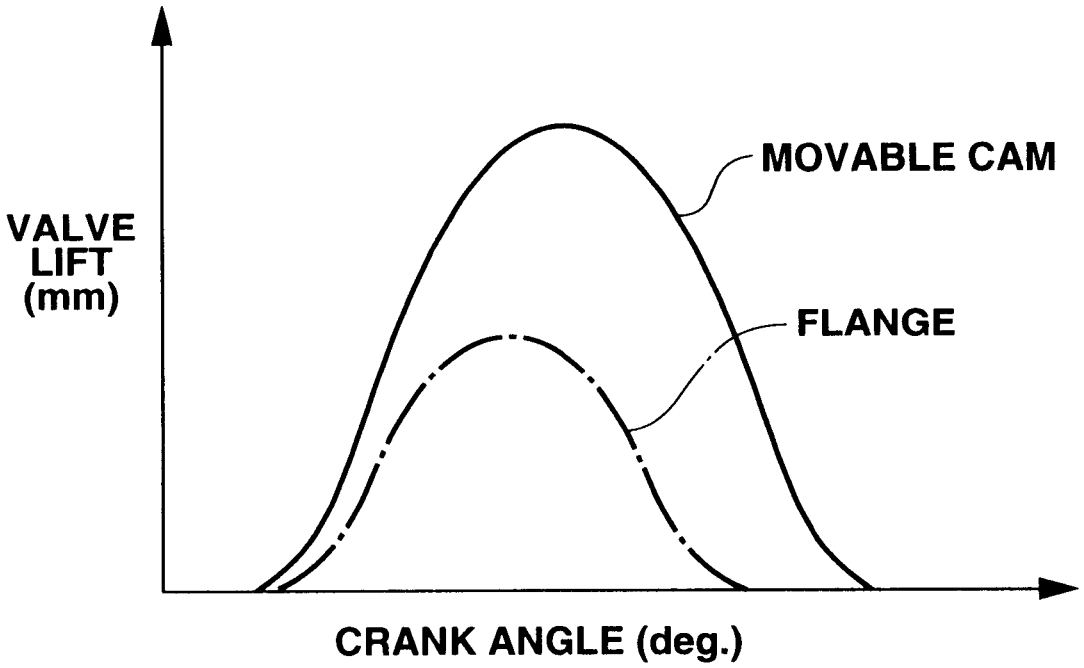
FIG. 16 is a view similar to FIG. 10, illustrating valve lift characteristics in the sixth embodiment.

On the other hand, under high rotation and heavy load of the engine, the movable cam 17 and the camshaft 13 are integrated with each other by the engaging releasing means 19, so that the second intake valve 12 is actuated in an open and closed way in accordance with the lift characteristics of the first cam lift portion 24 having high valve lift as illustrated by solid line in FIG. 16, obtaining high engine output.

Figure 17:
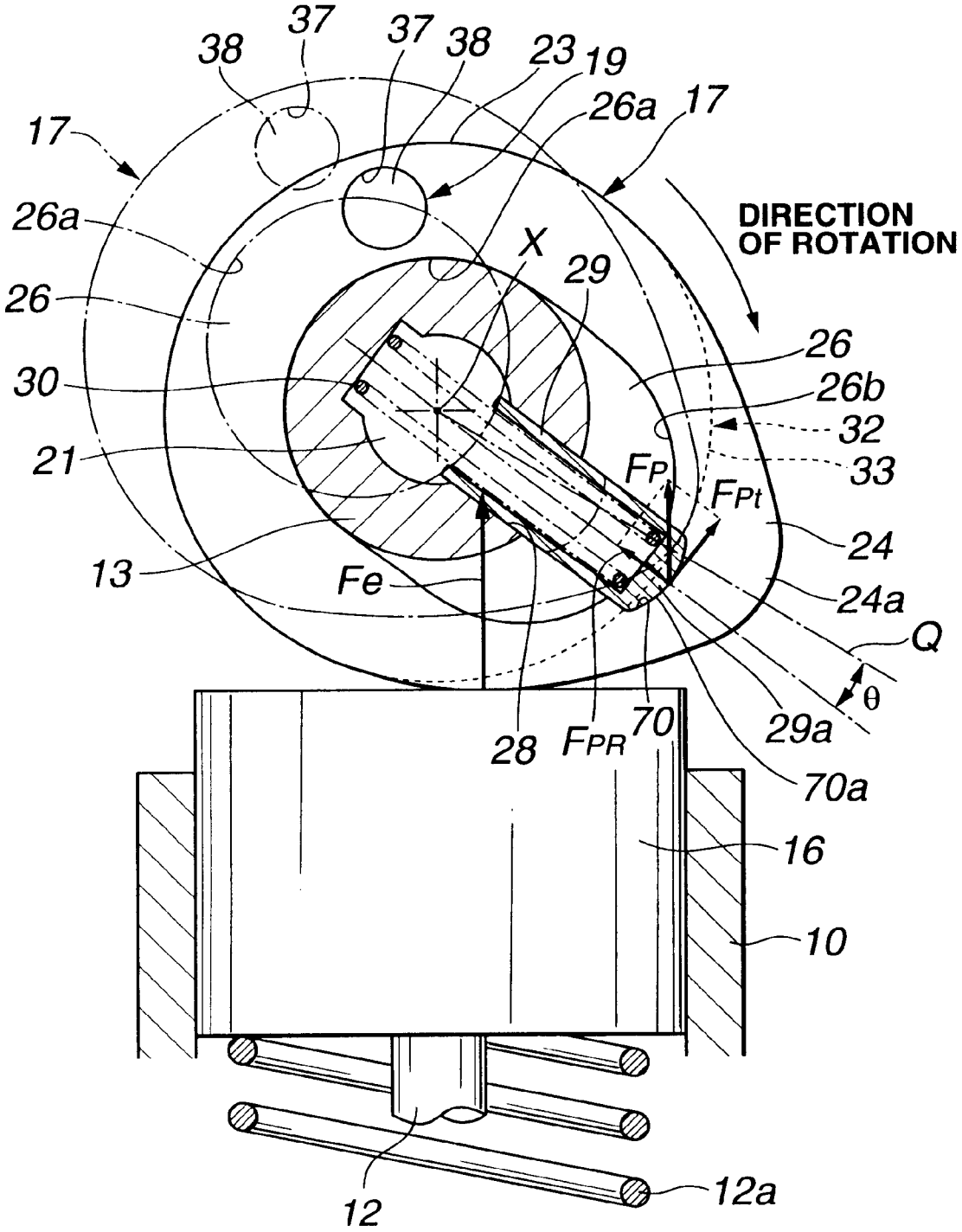
FIG. 17 is a view similar to FIG. 15, showing a seventh embodiment of the present invention.
Figure 18:
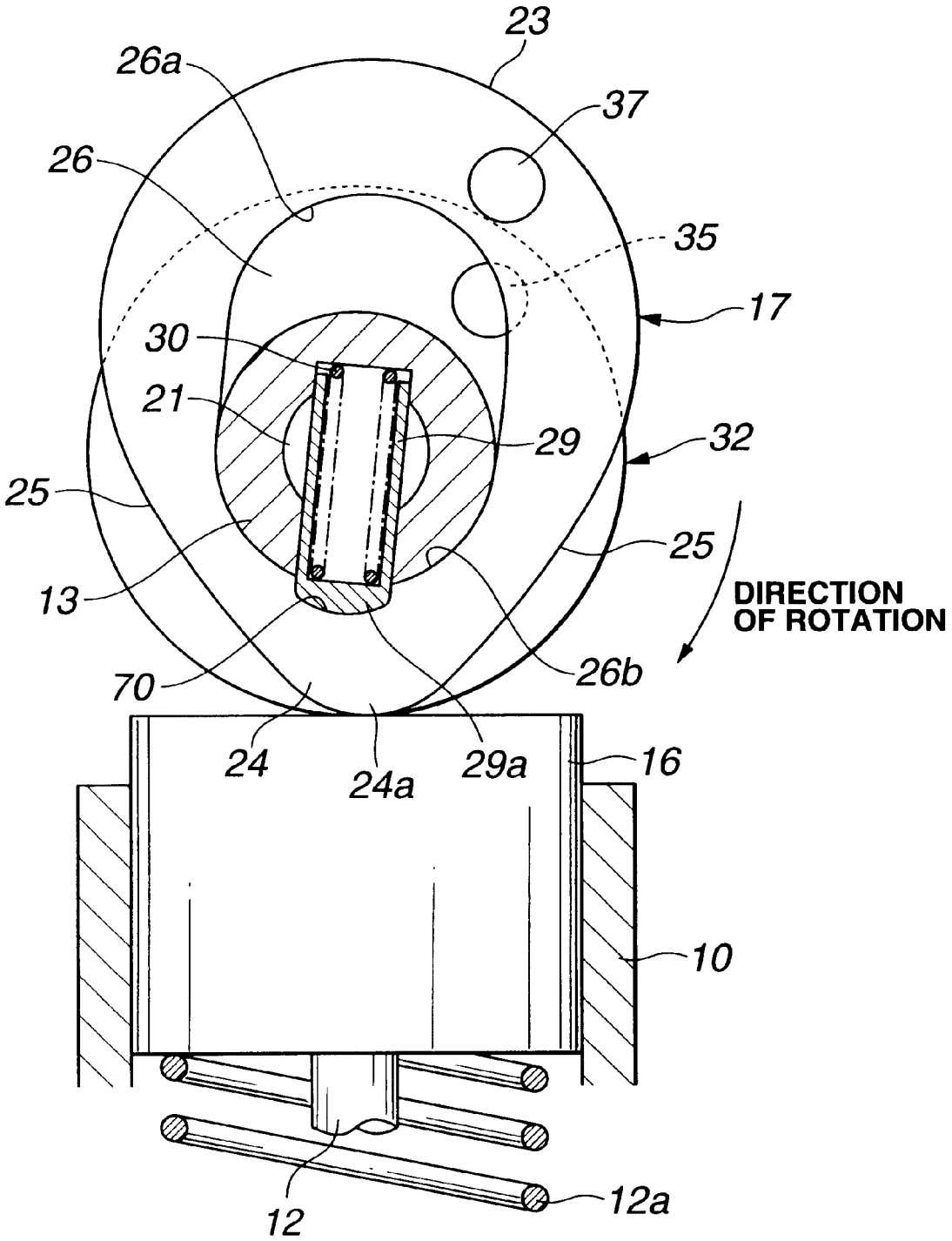
FIG. 18 is a view similar to FIG. 17, explaining operation of the seventh embodiment.
Figure 19:
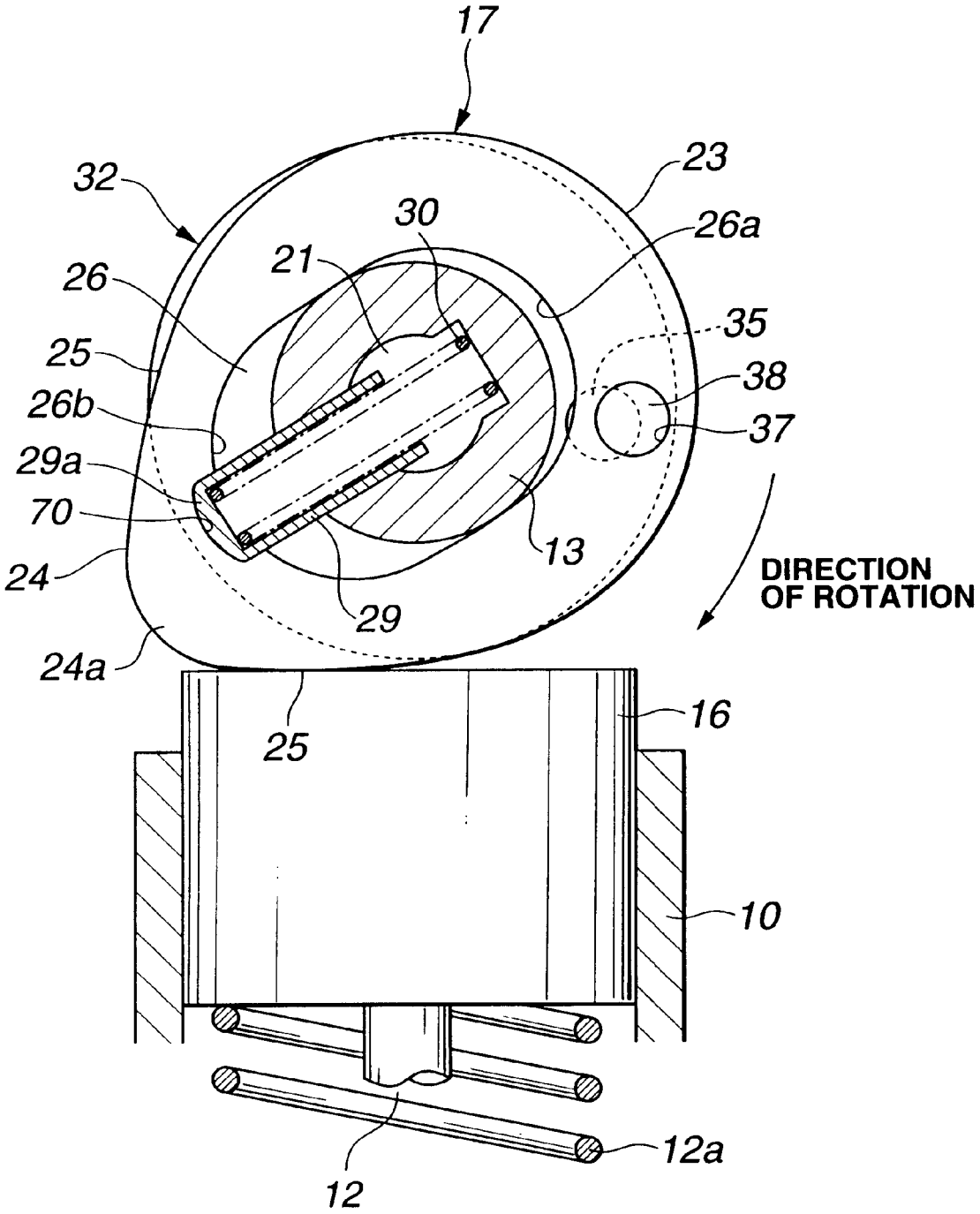
FIG. 19 is a view similar to FIG. 18, explaining operation of the seventh embodiment.

FIGS. 17–19 show a seventh embodiment of the present invention wherein the structure of the movable cam 17 is fundamentally the same as that in the first embodiment except that an engagement recess 70 is formed in the inner peripheral surface of the another end 26*b* of the slider opening 26, with which the head 29*a* of the plunger 29 is engaged.

Specifically, the another end 26*b* of the slider opening 26 has the same bottom depth as that in each of the above embodiments so that when the movable cam 17 moves backward maximally through the camshaft 17, the top 24*a* of the cam lift portion 24 is at the same level as that of the base circle portion 23.

The engagement recess 70 of the inner peripheral surface of the another end 26*b* is shaped to be engageable with the head 29*a* of the plunger 29, and has a center at an angle θ on the forward side as viewed in the direction of rotation of the movable cam 17 with respect to a line Q connecting the top 24*a* of the cam lift portion 24 and an axis X of the camshaft 13. Then, the plunger hole 28 of the camshaft 13 is formed to have an axis corresponding to the center of the engagement recess 70, so that the plunger 29 slides slantwise forward as viewed in the direction of rotation of the movable cam 17 with respect to the line Q. The plunger 29 and the engagement recess 70 serve as a support mechanism for rotating the movable cam 17 together with the camshaft 13.

The seventh embodiment is also provided with the flange 32 coupled with the camshaft 13. The flange 32, which has no function as a support mechanism as in the first and second embodiments, is formed with the receiving hole 35 corresponding to the engagement hole 37 of the movable cam 17 in the same way as the second embodiment so as to constitute part of the engaging releasing means 19. Moreover, the flange 32 has an outer diameter substantially equal to the outer diameter of the base circle portion 23 of the movable cam 17 so that the outer peripheral surface faces the top face of the valve lifter 16 with a small valve clearance.

According to the seventh embodiment, the plunger 29 protrudes by a biasing force of the return spring 30 or by the hydraulic pressure within the oil passage 21 regardless of the engine operating conditions to have the head 29*a* always engaged with the engagement recess 70. As a result, the movable cam 17 is supported in synchronous rotation with the camshaft 13. Under low rotation and light load of the engine, as described above, coupling of the movable cam 17 with the flange 32 is released by the engaging releasing means 19, so that the movable cam 17 moves forward and backward through the camshaft 13 and the slide hole 26 as shown in FIGS. 17–19 to have the outer peripheral surface in slide contact with the top face of the valve lifter 16. When, subsequent to the base circle portion 23 and the ramp portion 25, the cam lift portion 24 reaches the top face of the valve lifter 16 as shown in FIGS. 17–18, the plunger 29 is pushed back by a biasing force of the valve spring 12*a*. Then, the movable cam 17 moves backward in its entirety to the another end 26*b* of the slider opening 26 through the camshaft 13, i.e. the cam lift portion 24 moves backward maximally up to substantially the same level as that of the outer peripheral edge of the flange 32, obtaining the another end 26*b* engaged with the camshaft 13.

As shown in FIG. 19, when the movable cam 17 rotates further to involve the other ramp portion 25, the engagement position of the movable cam 17 with respect to the camshaft 13 passes from the another end 26*b* to the one end 26*a* of the slider opening 26, so that the cam lift portion 24 moves forward by a biasing force of the return spring 30. At this time, the outer peripheral surface of the ramp portion 25 follows to abut on the top face of the valve lifter 16 by a biasing force of the return spring 30, preventing quick rotation of the movable cam 17. That is, if no engagement recess 70 exists, a contact point of the head 29*a* and the another end 26*b* will be displaced immediately after the top 24*a* of the cam lift portion 24 passes on the top face of the valve lifter 16. And the movable cam 17 may move quickly in the direction of rotation by a biasing force of the return spring 30 while being in slide contact with the top face of the valve lifter 16, resulting in possible occurrence of the click phenomenon. According to the seventh embodiment, however, the head 29*a* of the plunger 29 engages with the engagement recess 70, so that even if the movable cam 17 starts to rotate quickly, the edge of the engagement recess 70 abuts on the outer peripheral surface of the head 29*a* of the plunger 29 to prevent quick rotation of the movable cam 17, obtaining the same rotating speed as that of the camshaft 17.

This can effectively prevent occurrence of hammering and wear due to slight collision between the top face of the valve lifter 16 and the outer peripheral surface of the movable cam 17 and between the outer peripheral surface of the camshaft 13 and the inner peripheral surface of the one end 26*a* of the slider opening 26.

Moreover, the engagement recess 70 is formed at an angle θ on the forward side as viewed in the direction of rotation of the movable cam 17 with respect to the top 24*a* of the cam lift portion 24. Thus, when the cam lift portion 24 is pushed back by a biasing force of the valve spring 12*a* through the top face of the valve lifter 16 as shown in FIGS. 17–18, backward motion of the movable cam 17 is readily carried out in its entirety.

Specifically, as shown in FIG. 17, when the top 24*a* of the cam lift portion 24 reaches the top face of the valve lifter 16, an upward force Fe of a biasing force of the valve spring 12*a* acts on the movable cam 17. The upward force Fe acts on the plunger 29 in the form of a component Fp applied to the plunger head 29*a* from a bottom 70*a* of the engagement recess 70, a component Fpt in the direction of rotation of the component Fp, and a component FPR in the radial direction of the component Fp. Therefore, when the plunger 29 is coaxial with the top 24*a*, the rotation-direction component force Fpt applied to the plunger head 29*a* is greater whereas the radial-direction component force FPR is smaller. This makes a slide resistance between the plunger 29 and the plunger hole 28 relatively large, which may result in impossible quick backward motion of the movable cam 17. According to the seventh embodiment, however, the engagement recess 70 is formed on the forward side as viewed in the direction of rotation of the movable cam 17 as described above, so that it is possible to fully increase the radial-direction component force FPR, and decrease a slide resistance between the plunger 29 and the plunger hole 28, obtaining quick backward motion of the movable cam 17.

Moreover, according to the seventh embodiment, the support mechanism includes no flanges 32, 33 nor support pin 34 as in the first embodiment, but the plunger 29 and the engagement recess 70 only, resulting in not only simplified structure and weight reduction of the mechanism, but improved efficiency of manufacturing and assembling thereof.

FIGS. 20–24 show an eighth embodiment of the present invention wherein the structure of the movable cam 17 is fundamentally the same as that in the first embodiment except that the support mechanism comprises a connecting rod 80 arranged at the rear end of the plunger 29 to move forward and backward together with forward and backward motion of the plunger 29.

Figure 20:
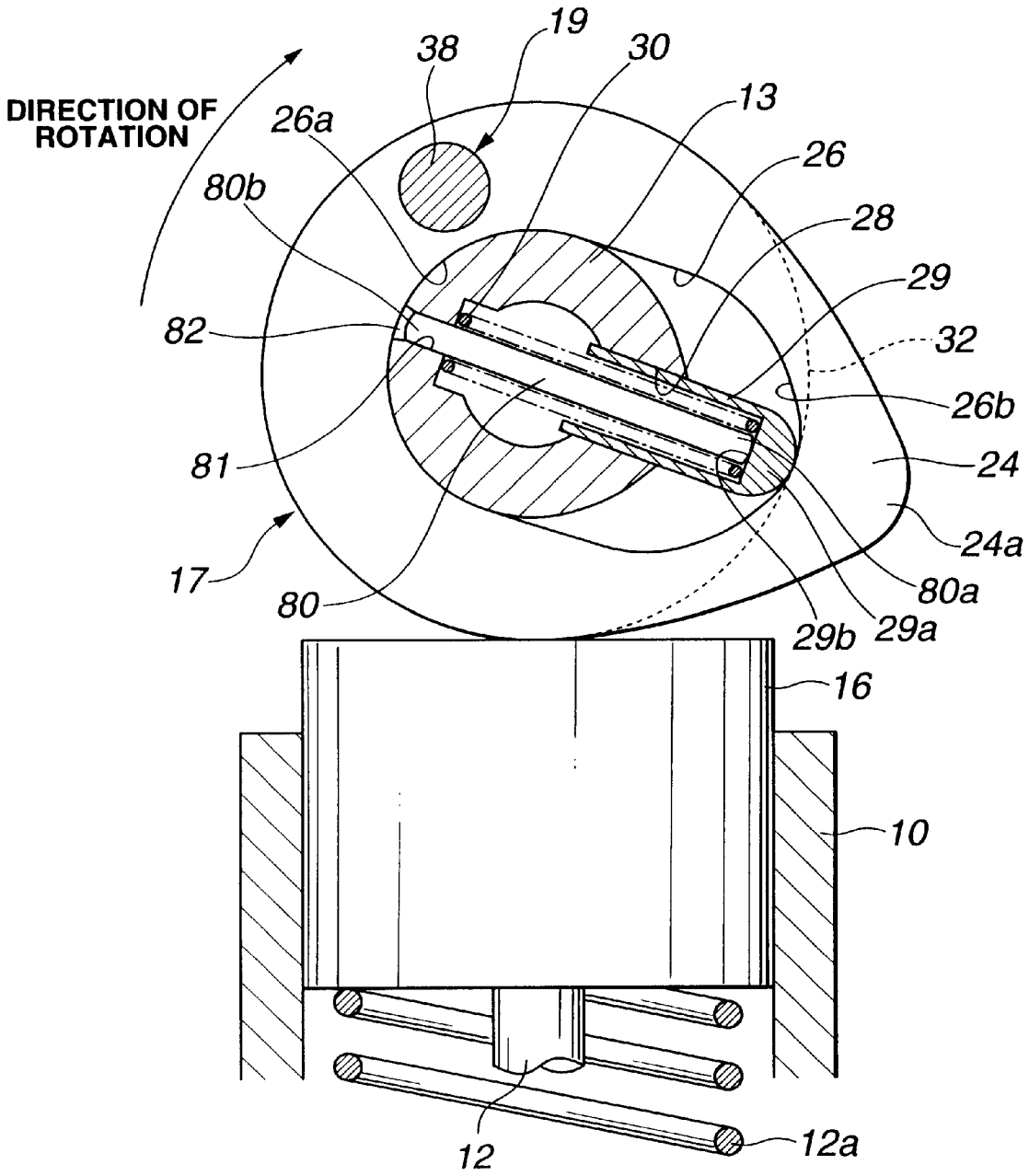
FIG. 20 is a view similar to FIG. 19, showing an eighth embodiment of the present invention.

Specifically, the connecting rod 80 has one end 80*a* abutting on a bottom 29*b* of the head 29*a* of the plunger 29 and another end slidably arranged in a slide hole 81 formed radially through the camshaft 13 to be coaxial with the plunger hole 28. A head edge of the another end 80*b* faces the inner peripheral surface of the one end 26*a* of the slider opening 26. When the cam lift portion 24 of the movable cam 17 is in protrusion as shown in FIG. 20, a small clearance 82 is defined between the head edge of the another end 80*b* of the connecting rod 80 and the inner peripheral surface of the one end 26*a* of the slider opening 26. The connecting rod 80 is slidable together with the plunger 29 through the clearance 82 in the diametral direction of the camshaft 13.

In the eighth embodiment, under low rotation and light load of the engine where coupling of the movable cam 17 with the camshaft 13 is released by the engaging releasing means 19, immediately before the movable cam 17 depresses the valve lifter 16 as shown in FIG. 20, the plunger 29 moves forward the cam lift portion 24 of the movable cam 17 through the return spring 30 with the head 29*a* abutting on the inner peripheral surface of the another end 26*b* of the slider opening 26.

Figure 21:
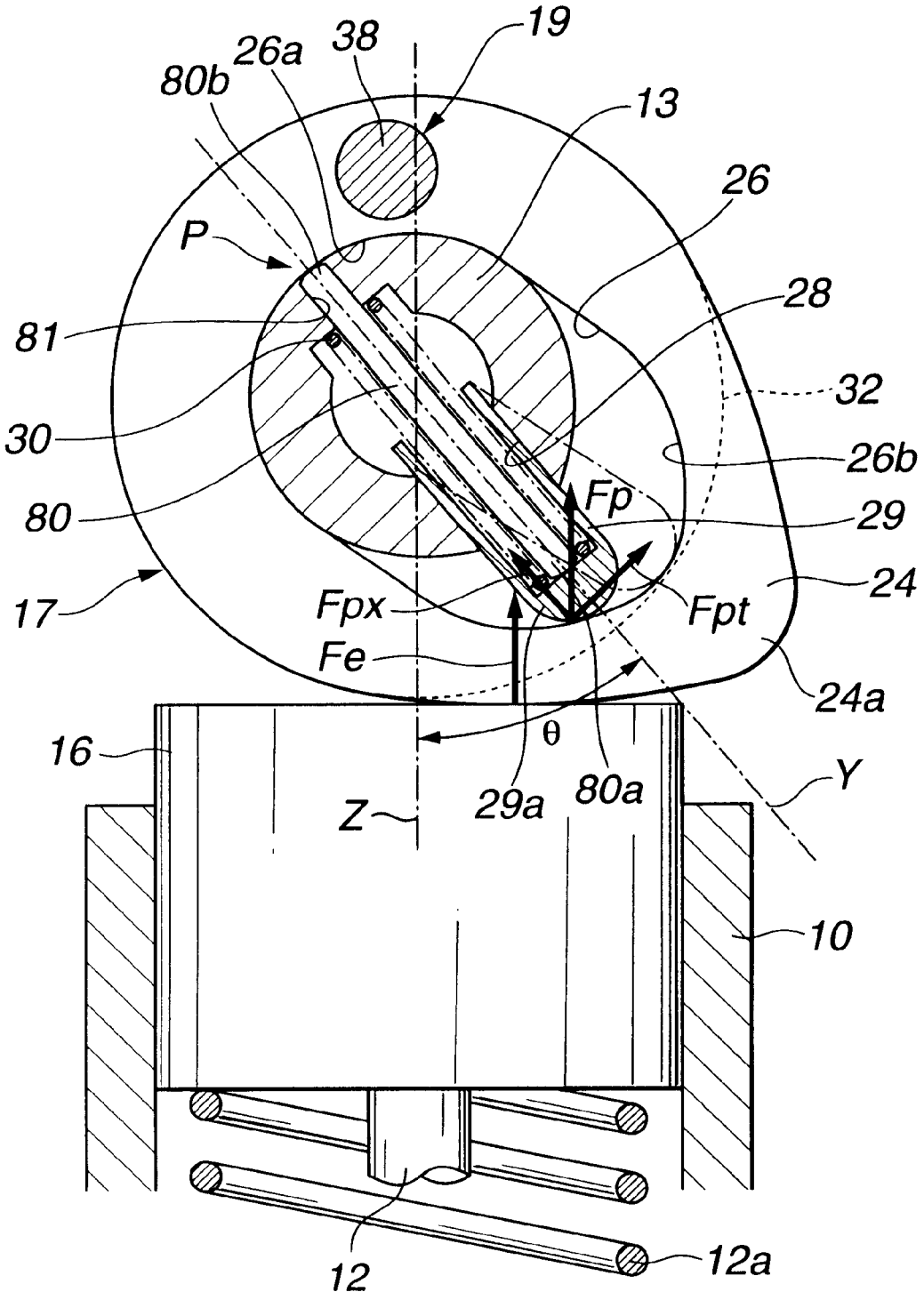
FIG. 21 is a view similar to FIG. 20, explaining operation of the eighth embodiment.
Figure 22:
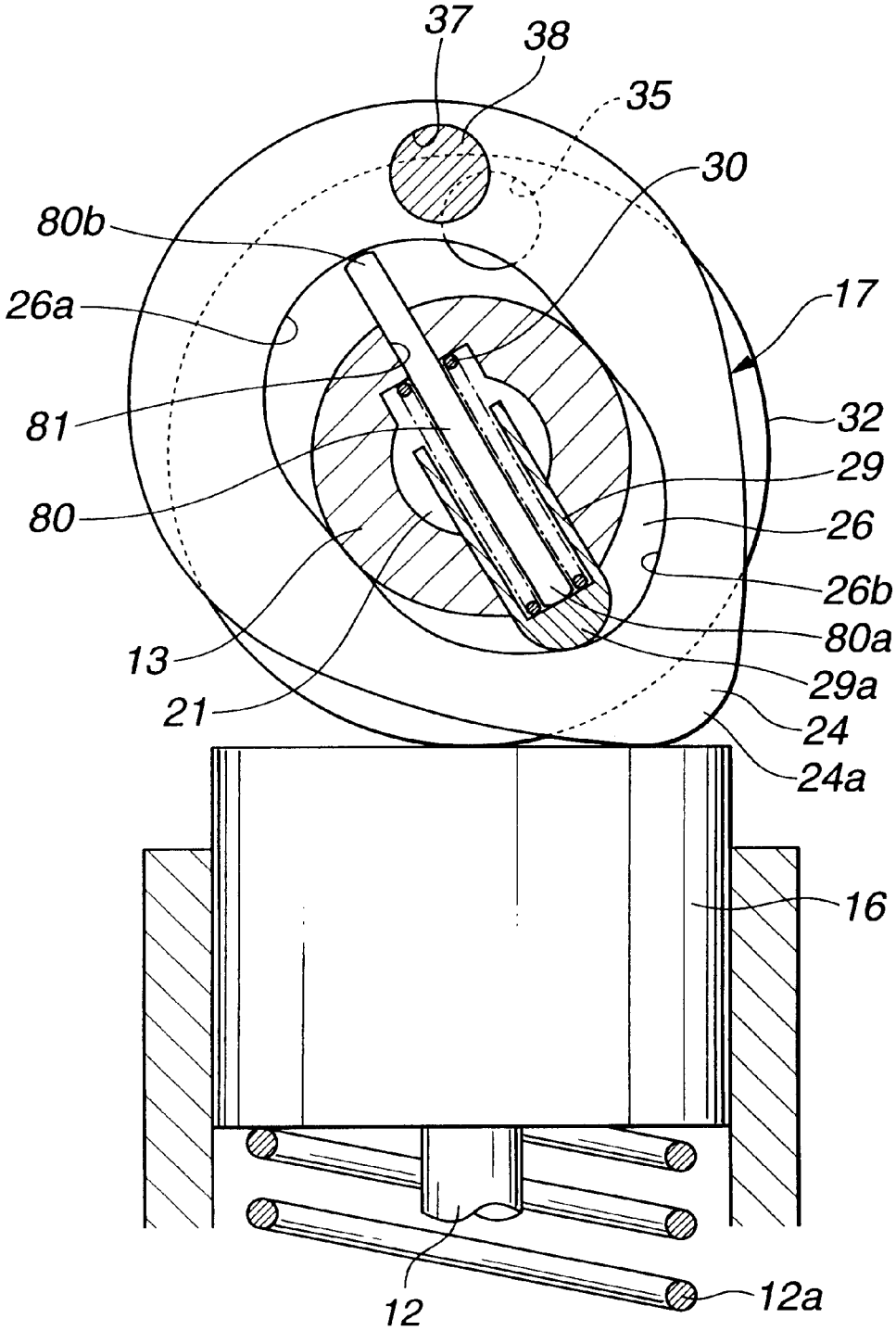
FIG. 22 is a view similar to FIG. 21, explaining operation of the eighth embodiment.

When the camshaft 13 rotates clockwise as shown in FIG. 21, the movable cam 17 undergoes counterclockwise torque due to rotation of the cam lift portion 24 restricted by the valve lifter 16. As a result, the head 29*a* of the plunger 29 moves backward while sliding on the inner peripheral surface of the another end 26*b*, so that the plunger 29 pushes up the connecting rod 80 until the clearance 82 is eliminated, and rotates from the position as illustrated by chain line in FIG. 21 to the position at an angle θ with respect to an axis of the second intake valve 12. That is, at this time, in the same way as in the seventh embodiment, when the top 24*a* of the cam lift portion 24 reaches the top face of the valve lifter 16, the upward force Fe of a biasing force of the valve spring 12*a* acts on the movable cam 17. An angular moment of the movable cam 17 resulting from the upward force Fe acts on the contact point of the plunger head 29*a* from the inner peripheral surface 26*b* of the slider opening 26, producing a side force Fpt of the plunger 29. The side force Fpt produces a component force Fp in the direction of the normal line at the contact point and a component force Fpx in the axial direction of the plunger 29. Here, a biasing force of the return spring is neglected, since the return spring is smaller in biasing force than the valve spring.

When the plunger 29 makes the movable cam 17 rotate against a biasing force of the valve spring 12*a*, the plunger 29 undergoes the great side force Fpt. This side force Fpt produces a friction between the plunger 29 and the plunger hole 28, which may cause difficult backward motion of the movable cam 17 and accelerated wear of slide portions of the plunger 29 and the plunger hole 28. In the eighth embodiment, since arrangement of the clearance 82 allows the plunger 29 to rotate from the position as illustrated by chain line to the position at the angle θ, the inner peripheral surface 26 is pushed up by the connecting rod 80 at a point P to move backward the movable cam 17, obtaining smaller plunger angle θ. This results in greater component force Fpx for axially pushing up the plunger 29. Due to the relationship of Fpx=Fpt tan θ, the plunger 29 is easy to move backward to make the movable cam 17 move to the side of the one end 26*a* of the inner peripheral surface 26.

Specifically, the connecting rod 80 serves to restrain a displacement of the direction of backward motion of the plunger 29 and the circumferential direction of the cam lift portion 24, and effectively transmit torque of the valve lifter 16 to the movable cam 17, allowing rotation of the movable cam 17 with the camshaft 13 and easy backward motion of the movable cam 17.

Figure 23:
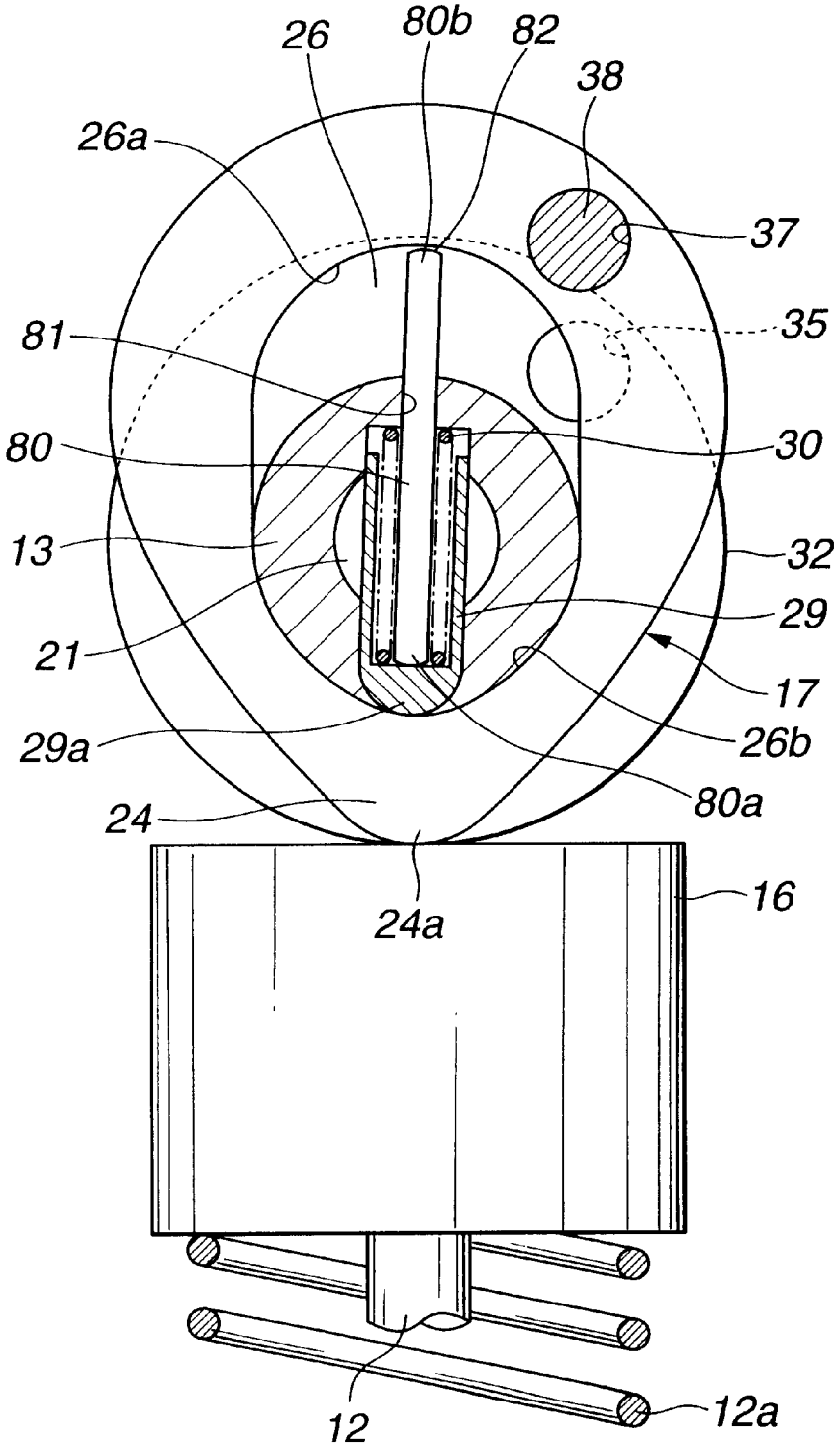
FIG. 23 is a view similar to FIG. 22, explaining operation of the eighth embodiment.

As shown in FIG. 23, when the camshaft 13 rotates further to have the top 24*a* of the cam lift portion 24 perpendicularly abutting on the top face of the valve lifter 16, the plunger 29 rotates in the direction of rotation slightly before the top 24*a* of the cam lift portion 24, wherein the movable cam 17 moves backward maximally, and the another end 80*b* of the connecting rod 80 is slightly separated from the inner peripheral surface of the one end 26*a* of the slider opening 26.

Figure 24:
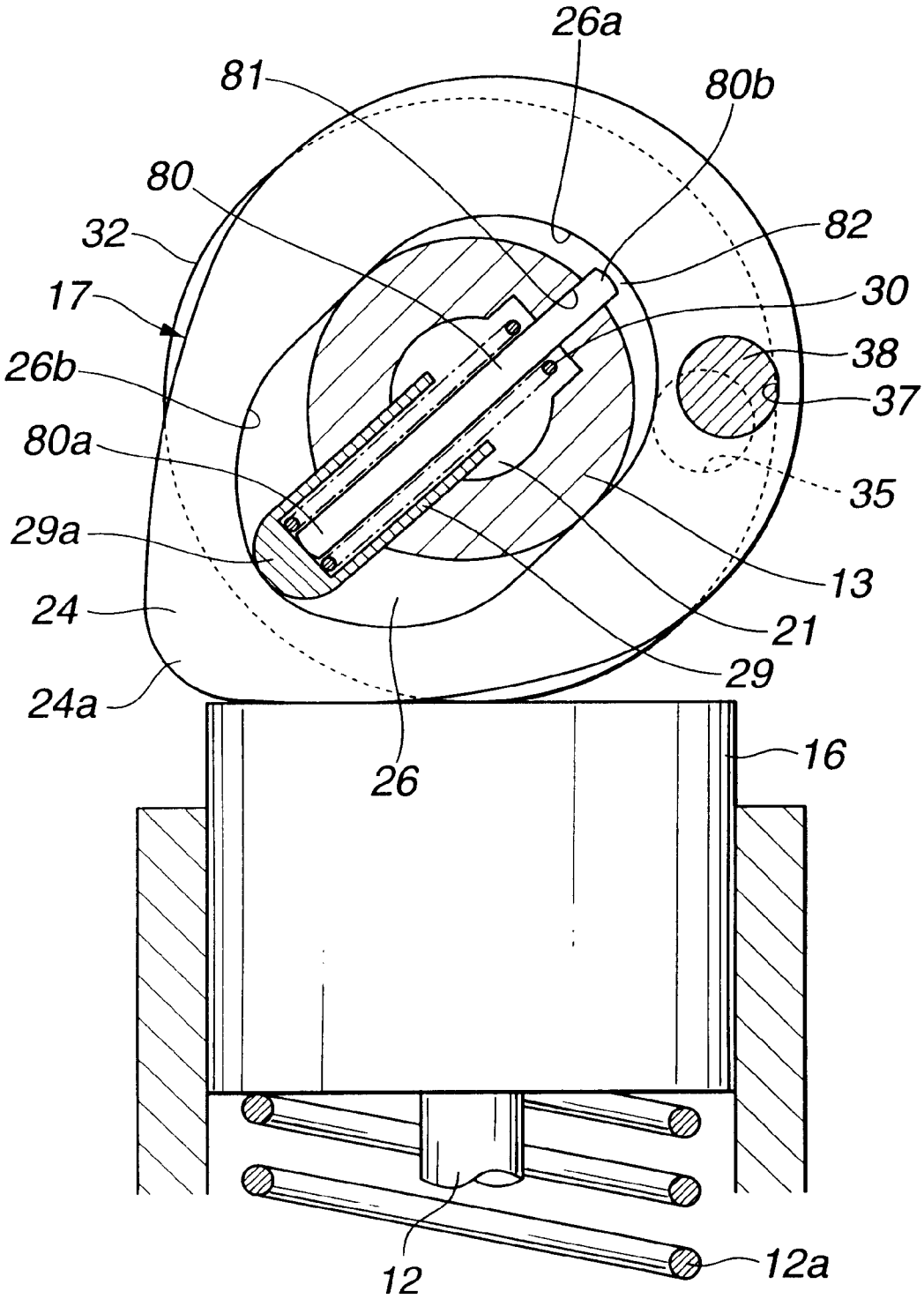
FIG. 24 is a view similar to FIG. 23, explaining operation of the eighth embodiment.

As shown in FIG. 24, when the camshaft 13 rotates further to have the top 24*a* of the cam lift portion 24 passing the top face of the valve lifter 16, the plunger 29 continuously presses the cam lift portion 24 through the inner peripheral surface of the another end 26*b* of the slider opening 26. Thus, the cam lift portion 24 rotates with the outer peripheral surface being in slide contact with the top face of the valve lifter 16. This avoids discontinuous slide contact of the top face of the valve lifter 16 with the outer peripheral surface of the cam lift portion 24 due to separation between the two, resulting possible prevention of hammering between the valve lifter 16 and the cam lift portion 24.

Moreover, as described above, since the clearance 82 is arranged between the another end 80*b* of the connecting rod 80 and the inner peripheral surface of the one end 26*a* of the slider opening 26, engagement of the connecting rod 80 with the inner peripheral surface of the one end 26*a* of the side hole 26 can be prevented at the initial stage of backward motion of the connecting rod, obtaining smooth backward motion thereof.

The eighth embodiment produces the same effect as that of the first embodiment, since the other structures such as the engaging releasing means 19 are the same as those in the first embodiment.

Figure 25:
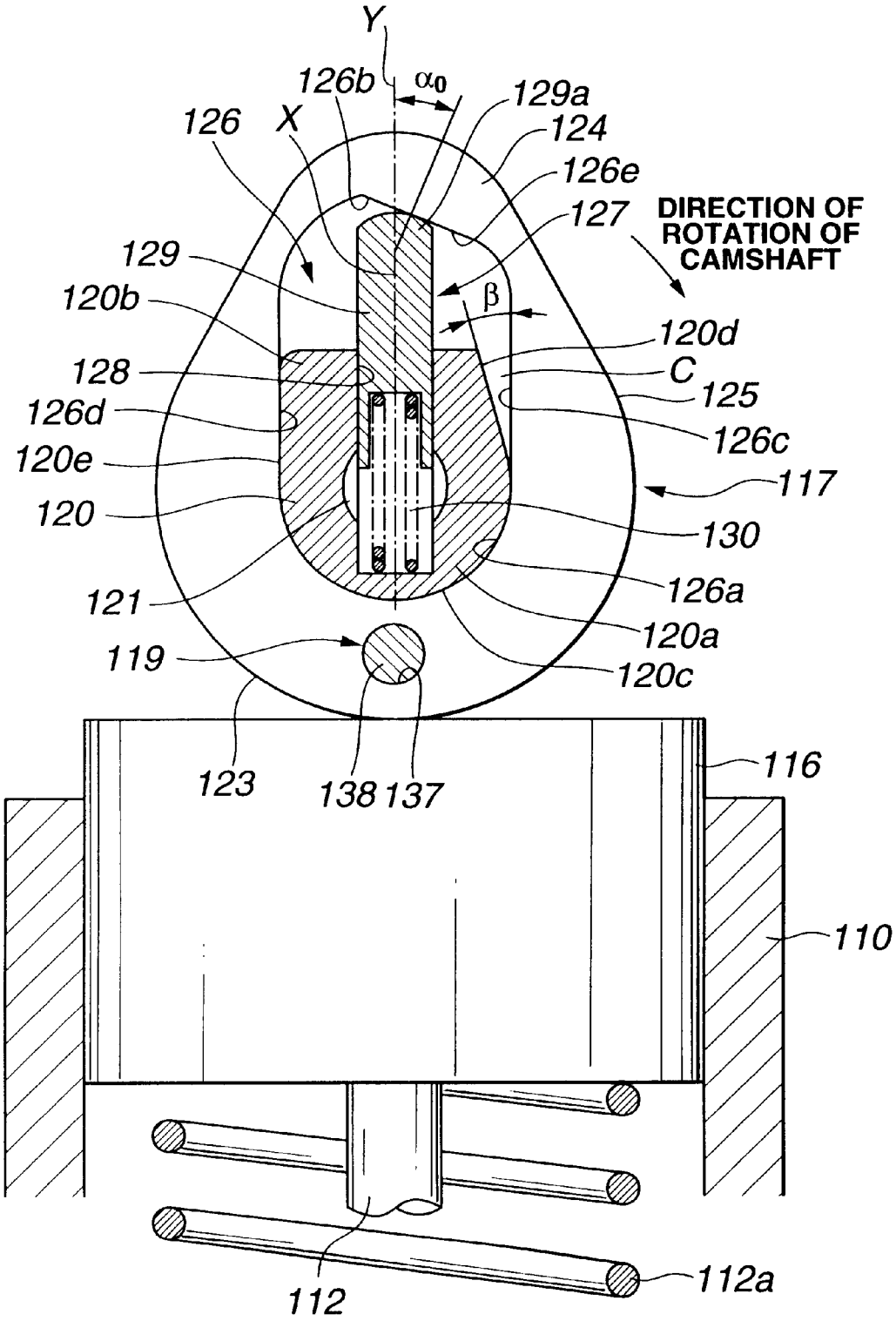
FIG. 25 is a view similar to FIG. 24, taken along the line XXV—XXV in FIG. 26, showing a ninth embodiment of the present invention.
Figure 26:
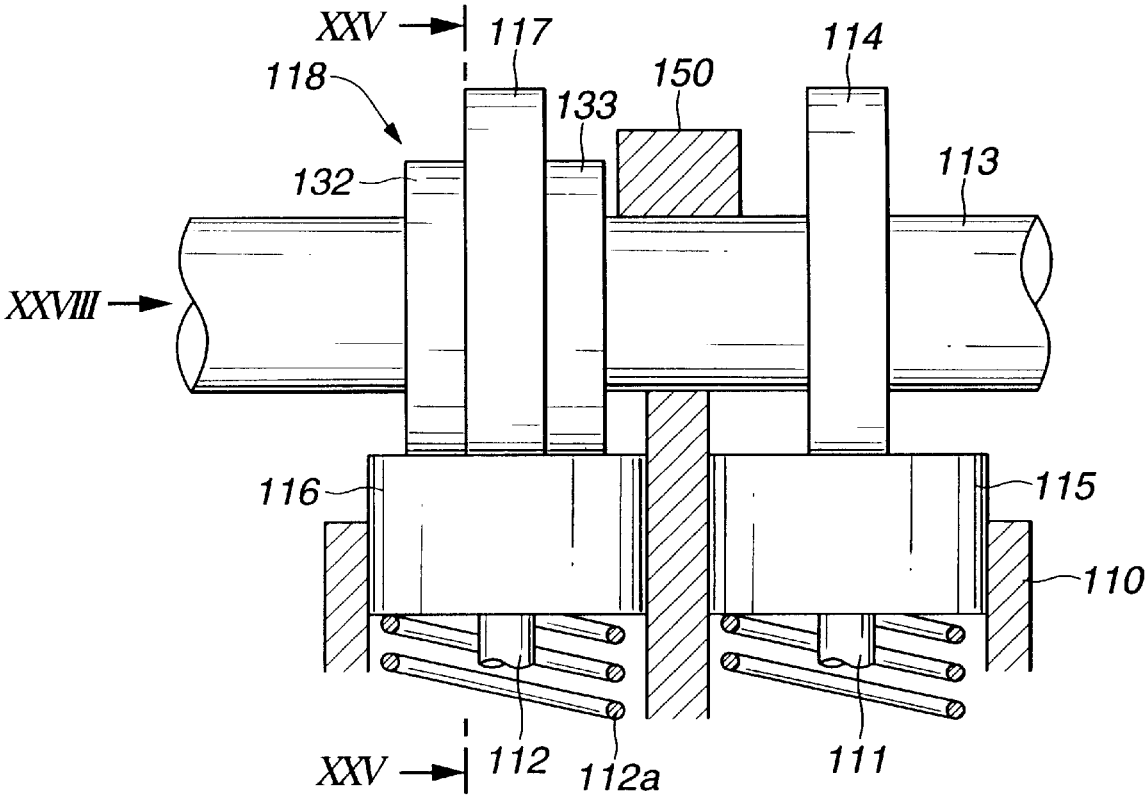
FIG. 26 is a view similar to FIG. 2, showing the ninth embodiment.

FIGS. 25–36 show a ninth embodiment of the present invention. Referring to FIG. 26, the cam driving controlling system is applied to an internal combustion engine including two intake valves 111, 112 per cylinder at a cylinder head 110. The first intake valve 111 is opened by an ordinary stationary cam 114 secured to a camshaft 113 through a valve lifter 115, whereas the second intake valve 112 is opened by the cam driving controlling system.

Specifically, referring also to FIG. 25, the cam driving controlling system is disposed above the cylinder head 110 and along the longitudinal direction of the engine, and comprises the camshaft 113 driven by torque transmitted from a crankshaft, a movable cam 117 arranged at the outer periphery of the camshaft 113 to be movable substantially in the radial direction of the camshaft and cooperating with a valve spring 112*a* to actuate the second intake valve 112 in an open and closed way through a lidded cylinder-shaped direct operated valve lifter 116, a support mechanism 118 arranged at the outer periphery of the camshaft 113 to support an end of the movable cam 117, means 119 for engaging the movable cam 117 with the camshaft 113 or releasing engagement in accordance with the engine operating conditions, and means 127 for biasing the movable cam 117 in the direction of forward motion of the cam nose portion 124.

As shown in FIG. 26, the camshaft 113 is supported by a bearing 150 arranged at an upper end of the cylinder head 110 to be rotatable clockwise as viewed in FIG. 25. An oil passage 121 is axially formed through the camshaft 113, to which the hydraulic pressure is supplied from a hydraulic circuit as will be described later. As best seen in FIG. 25, the camshaft 113 has a mounting portion 120 engaged with the movable cam 117 and having a substantially U-shaped cross section. One end 120*a* of the mounting portion 120 has a circular outer peripheral surface 120*c*. On the other hand, another end 120*b* includes one side face 120*d* on the forward side as viewed in the direction of rotation in FIG. 25, which is formed like a slant face inclined inward with respect to a tangent line of an outer peripheral surface 120*c* of the one end 120*a* in the direction of an axis Y of a plunger 129 as will be described later. Another side face 120*e* of the another end 120*b* on the backward side as viewed in the direction of rotation in FIG. 25 is formed like substantially a straight line extending along a tangent line of the outer peripheral surface 120*c* in the direction of the axis Y of the plunger 129.

Figure 36:
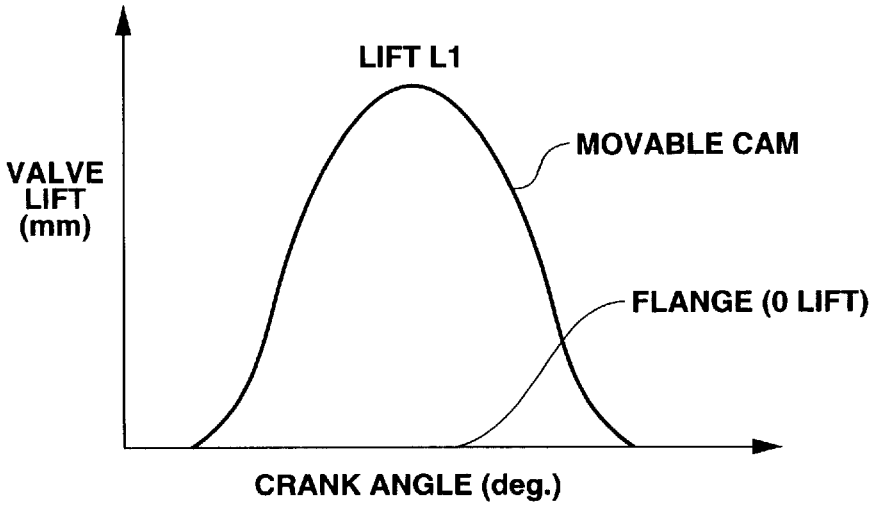
FIG. 36 is a view similar to FIG.16, illustrating valve lift characteristics in the ninth embodiment.

The movable cam 117 comprises a base circle portion 123 with a raindrop-shaped or roughly circular profile, a cam nose portion 124 protruding from an end of the base circle portion 123, a flank portion 125 located between the base circle portion 123 and the cam nose portion 124, which rotate to come in slide contact with the center of the top face of the valve lifter 116. The lift characteristics of the movable cam 117 are as shown in FIG. 36.

A slider opening 126 is formed through the center of the movable cam 117 to receive the mounting portion 120 of the camshaft 113. As best seen in FIG. 25, the slider opening 126 is shaped like roughly an oval along the radial direction of the camshaft 113, i.e. along the U-shape of the mounting portion 120. One end of the slider opening 126 on the side of the base circle portion 123 has an inner peripheral surface 126*a* formed roughly circularly along the circular outer peripheral surface 120*c* of the camshaft mounting portion 120. Another end of the slider opening 126 on the side of the cam nose portion 124 has an inner peripheral surface 126*b* formed with a slant face 126*e* inclined upward from the position on the forward side as viewed in the direction of rotation in FIG. 25 to the head of the cam nose portion 124. Side faces 126*c*, 126*d* between the inner peripheral surfaces 126*a*, 126*b* of both ends of the slider opening 126 are formed like substantially straight lines in parallel. The movable cam 117 rotates in the direction of rotation of the camshaft 113 by receiving a biasing force of the plunger 129 through the slant face 126*e*.

Thus, a β angle triangular clearance C is formed between the rotation-direction side face 126*c* of the slider opening 126*c* and the slant one side face 120*d* of the camshaft mounting portion 120. The clearance C allows the movable cam 117 to rotate with respect to the mounting portion 120 and in the direction opposite to the direction of rotation of the camshaft 113. Rotation of the movable cam 117 is restricted when the one side face 120*d* abuts on the one side face 126*c* of the slider opening 126. The another side face 120*e* of the mounting portion 120 and the another side face 126*d* of the slider opening 126 constitute means for restricting rotation of the movable cam 117 in the direction of rotation of the camshaft 113 over a predefined value.

The movable cam 117 is movably arranged so that the cam nose portion 124 can move forward by biasing means 127 through the slider opening 126. Specifically, as shown in FIG. 25, the biasing means 127 comprise a plunger hole 128 formed in the camshaft mounting portion 120 from the center of the another end 120*b* to the one end 120*a*, a plunger 129 slidably arranged in the plunger hole 128, and a return spring 130 for biasing the plunger 129 toward the inner peripheral surface 126*b* of the slider opening 126.

The plunger 129, which moves slidably in the plunger hole 128, is formed like a lidded cylinder, and has a head 129*a* with a spherical head face abutting on the inner peripheral surface 126*e* of the another end of the slider opening 126. The return spring 130 has one end resiliently held by the bottom of the plunger hole 128 and another end resiliently held by the upstream side of the supply and discharge passage 147 in accordance with a control signal of the controller 152, and ensures communication between the supply and discharge passage 147 and the drain passage 151. Thus, the receiving hole 135 is supplied with no hydraulic pressure from the oil pump 146, and with slight hydraulic pressure reduced by the orifice 150 via the bypass passage 149, having nearly zero hydraulic pressure.

Figure 27:
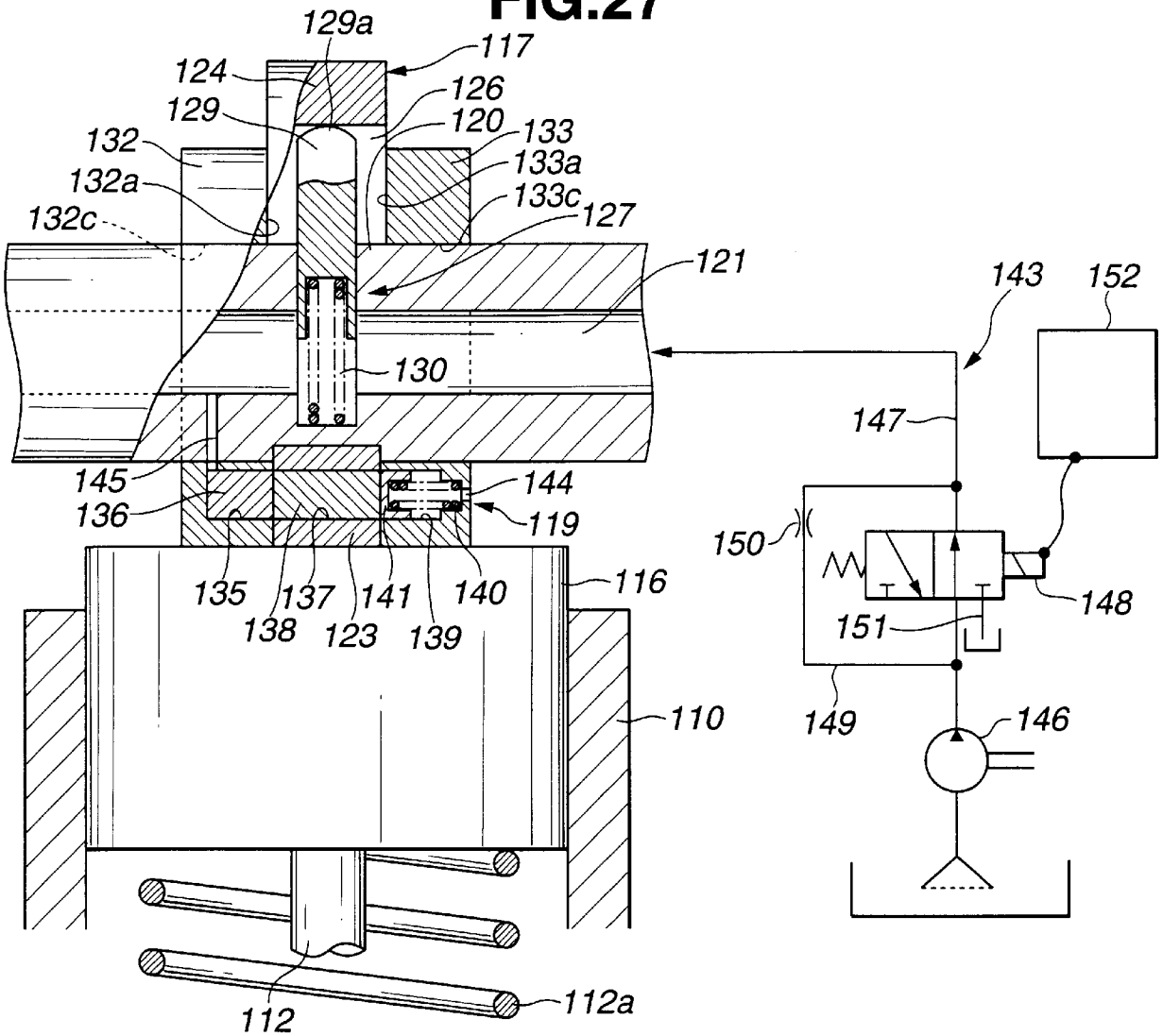
FIG. 27 is a view similar to FIG. 13, showing the ninth embodiment.

As a result, in the area of the base circle portion 123 of the movable cam 113, even with the receiving hole 135, the engagement hole 137, and the holding hole 139 aligned, the engaging piston 136, the pressing piston 138, and the biasing piston 141 are received in the respective holes 135, 137, 138 as shown in FIG. 27, being retained in the state of releasing engagement of the movable cam 117 with the camshaft 113.

The reason why the holes 135, 137, 139 are aligned in the area of the base circle portion 123 is as follows. Since the direction of contact of the plunger 129 with the slider opening 126 is inclined at an angle αo in the direction of rotation of the camshaft 113 with respect to the axis Y of the plunger 129 as shown in FIG. 25, the movable cam 117 undergoes a moment in the direction of rotation of the camshaft 113 from the plunger 129. Thus, the another side face 126*d* of the slider opening 126 as the restricting means abuts on the another side face 120*e* of the camshaft mounting portion 120 to restrict rotation of the movable cam 117 in the direction of rotation of the camshaft 113. The holes 135, 137, 139 are previously configured for alignment at that position.

However, due to engagement of the slider opening 126 with the camshaft mounting portion 120, the movable cam 117 rotates clockwise in synchronism with the camshaft 113 as shown in FIGS. 25 and 29–32.

When the outer peripheral surface of the movable cam 117 which has rotated clockwise comes in slide contact with the top face of the valve for selectively supplying and discharging the hydraulic pressure from the bottom of the receiving hole 135. A small-diameter air vent hole 144 is formed through a bottom wall of the holding hole 139 to secure free slide motion of the biasing piston 141.

The axial length of the engaging piston 136 and pressing piston 138 is set to be substantially the same as that of the corresponding receiving hole 135 and engagement hole 137, whereas the axial length of the biasing piston 141 is set to be smaller than that of the holding hole 139. The engagement hole 137 is positioned so that even when the cam nose portion 124 of the movable cam 117 moves backward maximally, both ends of the biasing piston 138 face the corresponding inside faces 132*a*, 133*a* of the flanges 132, 133.

As shown in FIG. 27, the hydraulic circuit 143 comprises an oil hole 145 radially formed in the camshaft 113 to communicate with the bottom of the receiving hole 135 and the oil passage 121, a hydraulic-pressure supply and discharge passage 147 having one end communicating with the oil passage 121 and another end communicating with an oil pump 146, a bidirectional solenoid valve 148 interposed between the oil pump 146 and the supply and discharge147, and an orifice 150 arranged with a bypass passage 149 for bypassing the solenoid valve 148.

The solenoid valve 148 is also connected to a drain passage 151, and ensures switching between the supply and discharge passage 147 and the oil pump 146 or the drain passage 151 by a microcomputer-based controller 152. The controller 152 provides a control signal to the solenoid. valve 148 in accordance with the engine operating conditions detected by various sensors such as a crank angle sensor, airflow meter, coolant temperature sensor and throttle-valve opening sensor, not shown.

Operation of the ninth embodiment will be described. Under low rotation and light load of the engine, the solenoid valve 148 shuts off the bottom of a cavity of the plunger 129.

Figure 28:
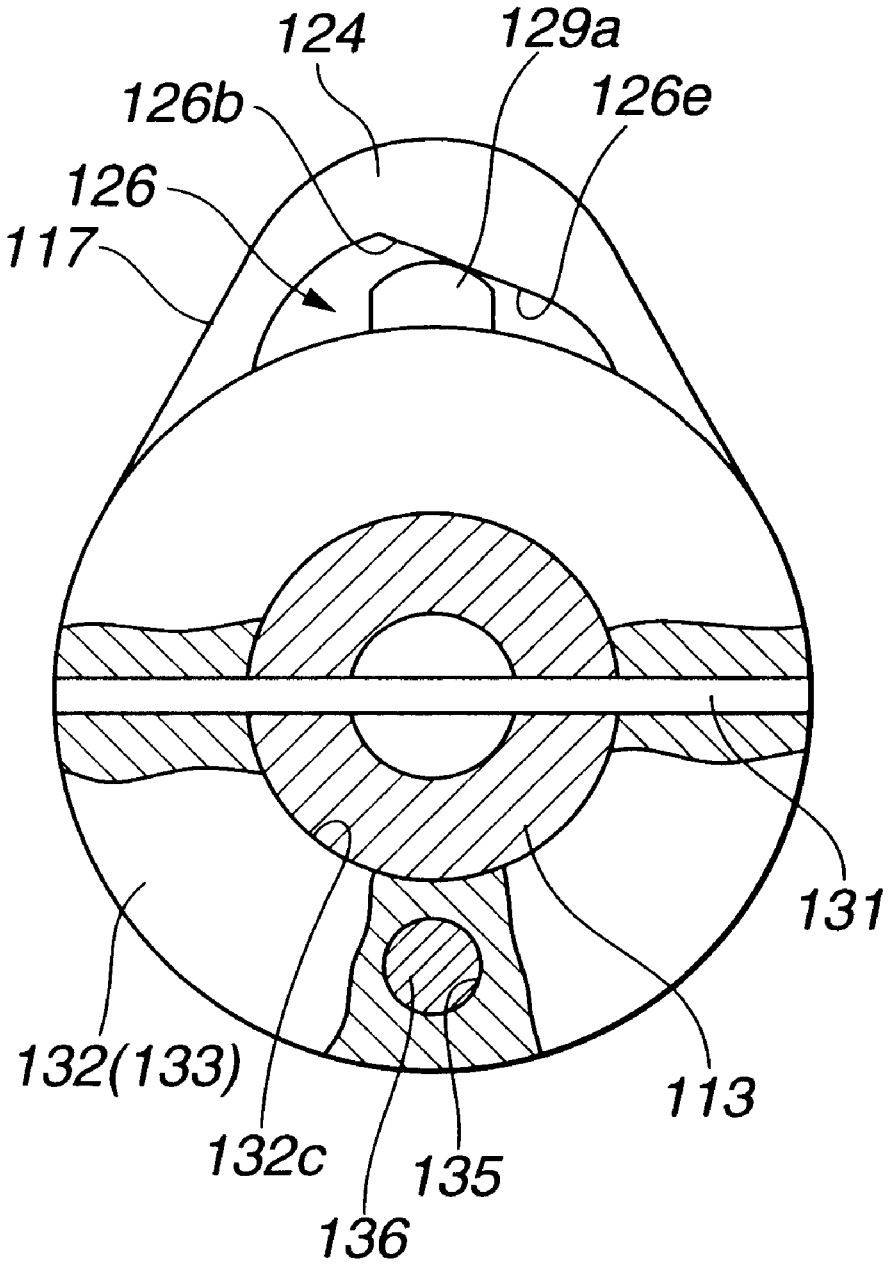
FIG. 28 is a view similar to FIG. 4, as viewed from arrow XXVIII.

As best seen in FIGS. 27–28, the support mechanism 118 comprises a pair of flanges 132, 133 disposed on both side faces of the movable cam 117, and securing pins 131 arranged diametrally through the flanges 132, 133 and the camshaft 113 to secure the flanges to the camshaft.

Each of the flanges 132, 133 is shaped roughly annularly with the outer diameter set to be substantially the same as that of the base circle portion 123 of the movable cam 117, and has in the center an engagement opening 132*c*, 133*c* engaged with the camshaft 113. Facing inside faces 132*a*, 133*a* of the flanges 132, 133 are in slide contact with the side faces of the movable cam 117. Moreover, when the cam nose portion 124 of the movable cam 117 moves backward, the outer peripheral surfaces of the flanges 132, 133 face the top face of the valve lifter 116 with a small clearance.

Figure 29:
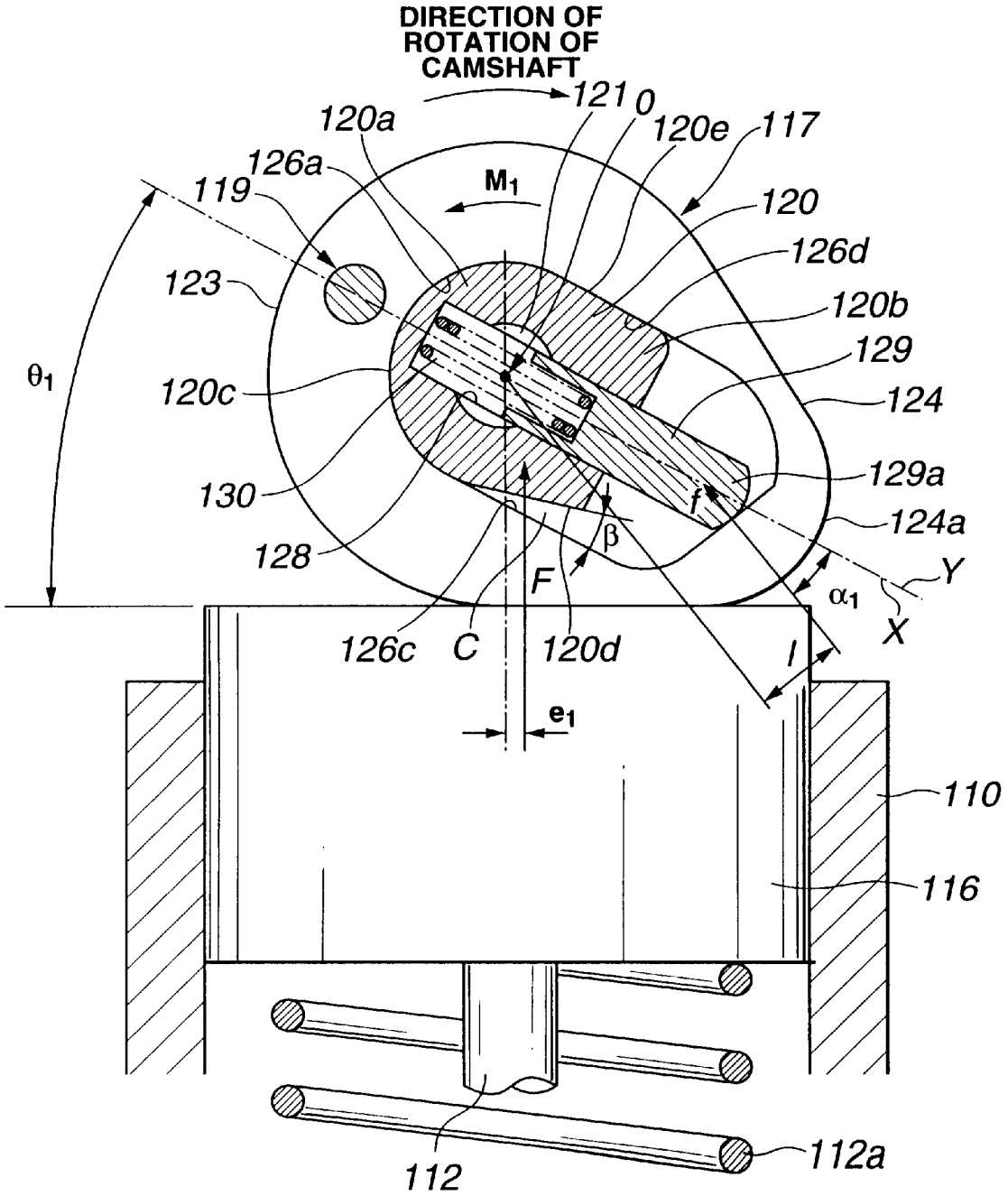
FIG. 29 is a view similar to 25, explaining operation of the movable cam in the ninth embodiment.

As shown in FIGS. 25 and 27, the engaging releasing means 119 comprise a bottomed receiving hole 135 formed in the first flange 132 to extend axially from the inside face 132*a* to the outside face, an engaging piston 136 slidably arranged to allow motion from the inside of the receiving hole 135 to the inside face, an engagement hole 137 formed axially through the base circle portion 123 of the movable cam 117 on a center line X connecting the center of the base circle portion 123 and the center of the head of the cam nose portion 124 so as to face the receiving hole 135 on the side of the base circle portion 123, a pressing piston 138 slidably arranged in the engagement hole 137 and having one end face facing one end face of the engaging piston 136 as required, a bottomed holding hole 139 formed in the second flange 133 to roughly correspond to the receiving hole 135, a biasing piston 141 arranged in the holding hole 139 and for moving backward the engaging piston 136 by a biasing force of a spring member 140 through the pressing piston 138, and a hydraulic circuit 143 lifter 116, and that subsequent to the base circle portion 123, the flank portion 125 reaches the top face of the valve lifter 116 to move a contact point e from a center O of the valve lifter 116 to a point e1 as shown in FIG. 29, a biasing force F of the valve spring 112*a* acts on the cam nose portion 124. Thus, a moment M1 (=F=e) in the direction opposite to the direction of rotation of the camshaft 113 acts on the movable cam 117. This makes the movable cam 117 start to rotate relative to the camshaft 113 (phase θ 1) in the direction opposite to the direction of rotation of the camshaft 113.

Moreover, the moment M1 produces a load f (=M1/1) which acts on the head 129*a* of the plunger 129. Here, since the direction of the axis Y of the plunger 129 is offset from the direction of the load f or direction of contact at a relatively small angle α1, the plunger 129 can easily be pushed back, but at a low speed due to a small absolute value of the load f.

As a result, relative rotation of the movable cam 117 in the direction opposite to the direction of rotation of the camshaft 113 mainly serves to absorb lift of the movable cam 117 to allow the valve lifter 116 and the intake valve 112 to maintain zero lift, obtaining smooth actuation of the movable cam 117 and the plunger 129.

Figure 30:
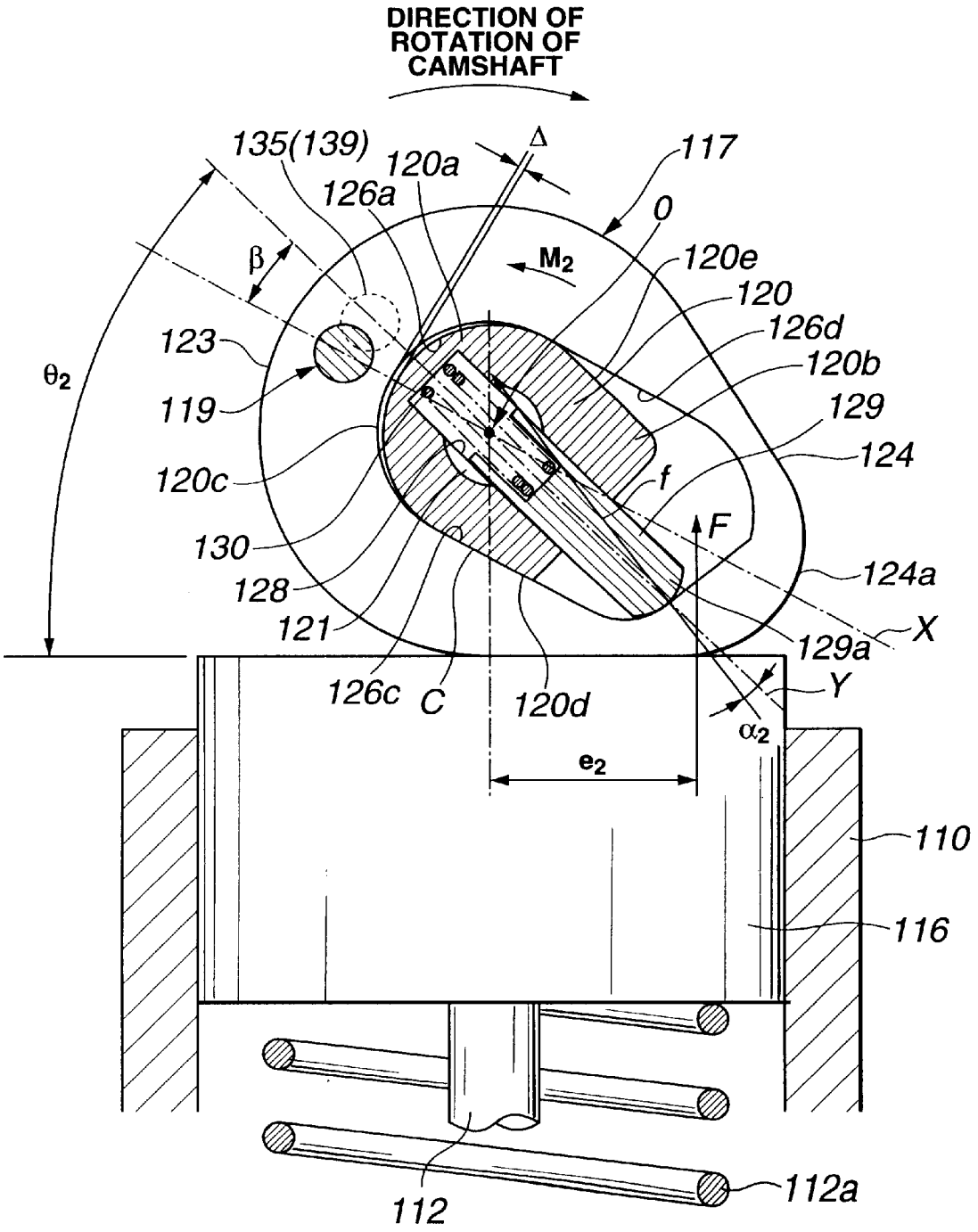
FIG. 30 is a view similar to 29, explaining operation of the movable cam in the ninth embodiment.

When the camshaft 113 rotates further (phase θ2) as shown in FIG. 30, the movable cam 117 contacts the top face of the valve lifter 116 through the cam nose portion 124, and rotates in the opposite direction until the clearance C is eliminated by a reaction force of the valve lifter 116, i.e. the one side face 126*c* of the slider opening 126 is restricted by abutting on the one side face 120*d* of the camshaft mounting portion 120. Thus, the movable cam 117 is lagged in phase in the direction of rotation of the camshaft 113 by approximately an angle β with respect to the camshaft 113, and the engagement hole 137 is also lagged in phase in the direction of rotation of the camshaft 113 by approximately the angle β with respect to the receiving hole 135.

Here, the movable cam 117 is slightly pushed back by an amount Δ through the slider opening 126, so that the contact position e of the cam nose portion 124 with the top face of the valve lifter 116 moves to a point e2 on the side of the head, having a relatively large value. Therefore, a moment M2 acting on the movable cam 117 becomes relatively large, which is received by restriction of the side faces 120*d*, 126*c*, providing relatively large load f to the plunger 129. Due to achievement of a smaller angle α2 formed by the direction of the axis Y of the plunger 129 and the direction of the load f and a larger value of the load f, the plunger 129 is pushed back smoothly quickly against a biasing force of the return spring 130. Lift of the movable cam 117 is effectively absorbed by excellent pushing-back operation of the plunger 129, maintaining valve lift of the intake valve 112 at zero.

Figure 31:
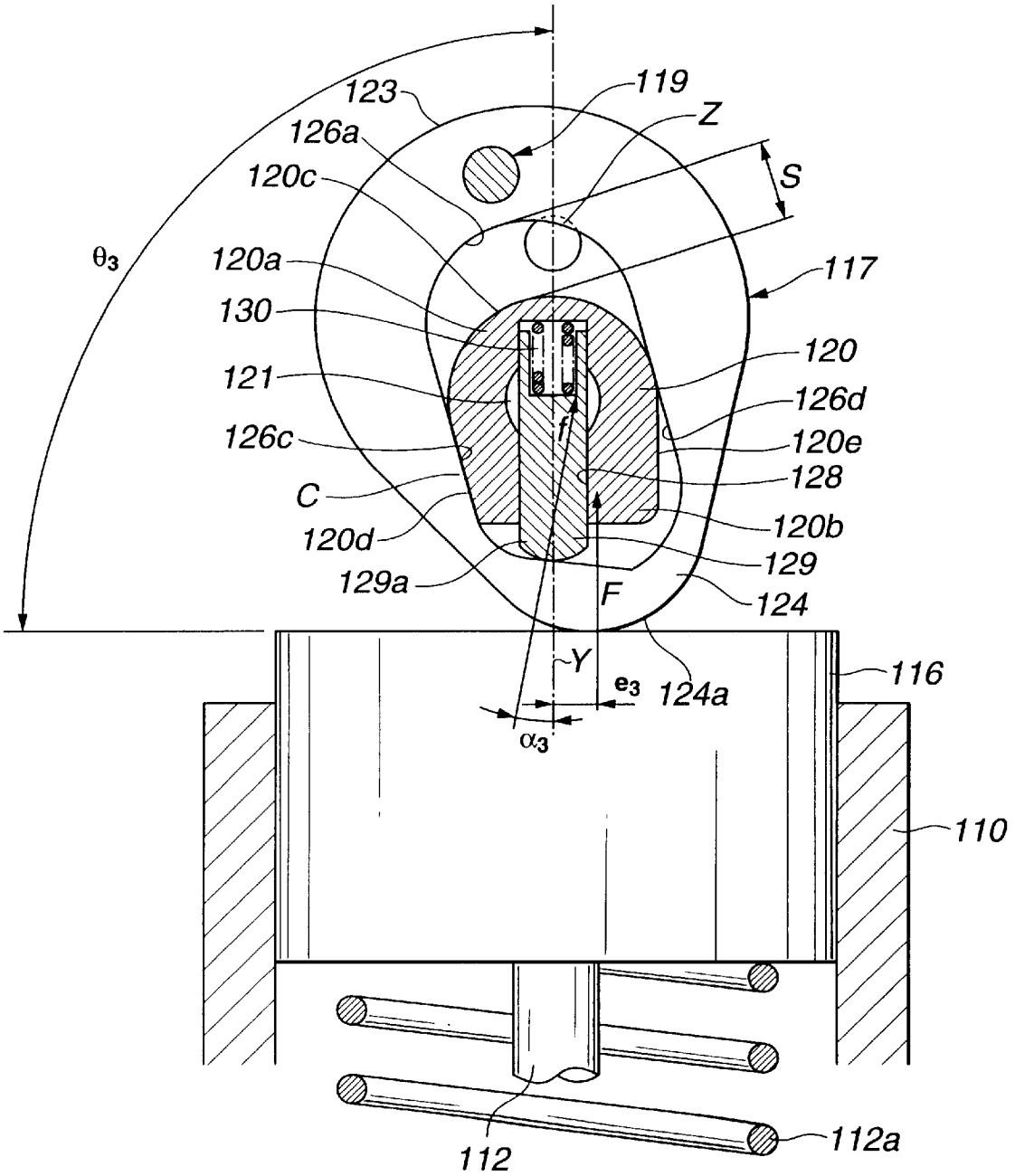
FIG. 31 is a view similar to 30, explaining operation of the movable cam in the ninth embodiment.

When the camshaft 113 rotates further (phase θ3) as shown in FIG. 31, the movable cam 117 is pushed back by restriction of the side faces 120*d*, 126*c* in accordance with pushing-back of the plunger 129. Here, since the direction of the axis Y of the plunger 129 and the direction of the load f forms a small angle α3, the plunger 129 is pushed back smoothly quickly. Moreover, the movable cam 117 is pushed back by a large amount S through the slider opening 126, so that lift of the movable cam 117 is also absorbed in the position as shown in FIG. 31, maintaining valve lift at zero.

Even when the movable cam 117 is pushed back by a larger amount in such a way, the receiving hole 135 and the holding hole 139 are partly positioned on the respective facing side faces of the movable cam 117 as illustrated by Z in FIG. 31, having no potential disengagement of the engaging piston 136 and the biasing piston 141.

Figure 32:
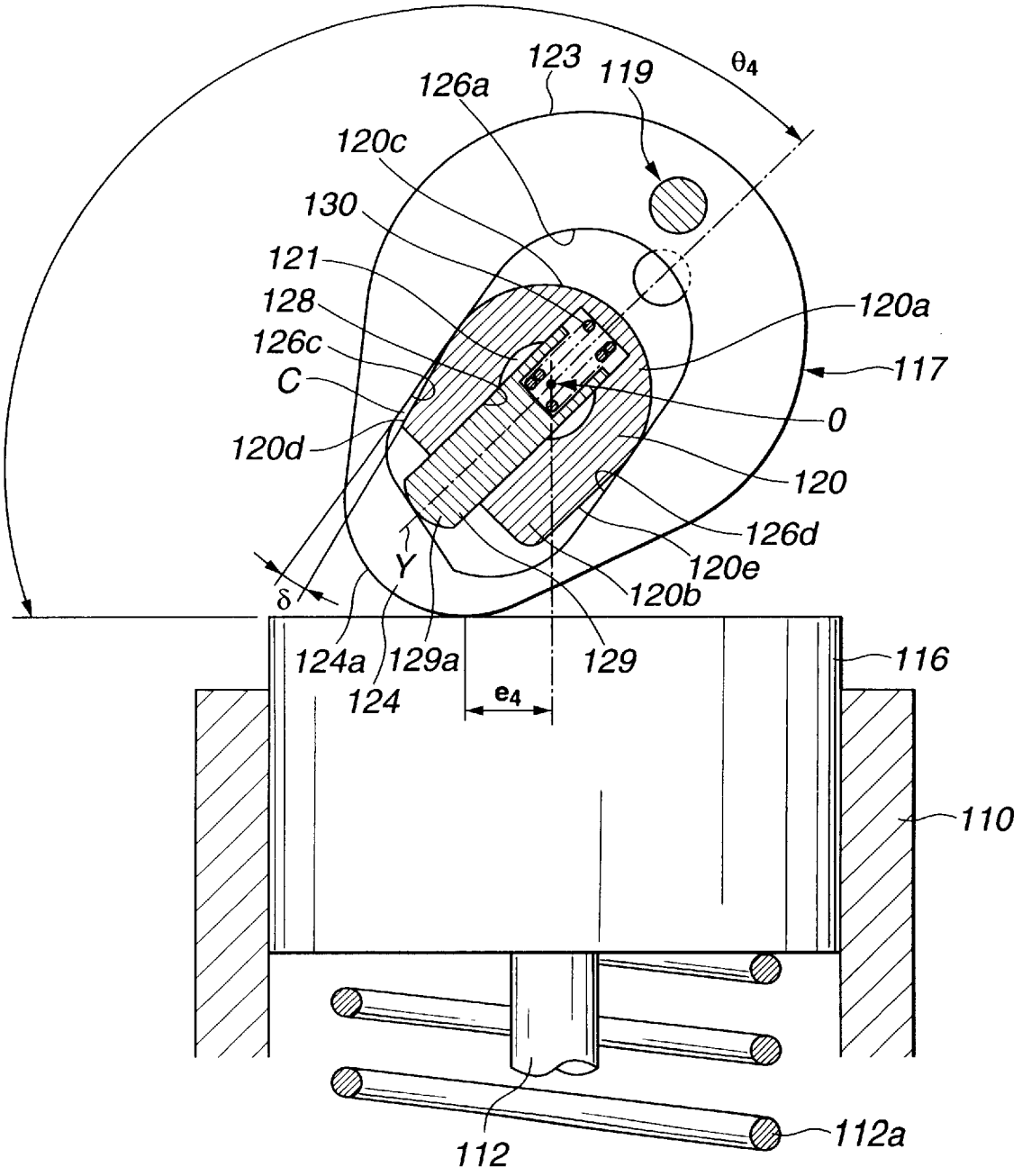
FIG. 32 is a view similar to 31, explaining operation of the movable cam in the ninth embodiment.
Figure 33:
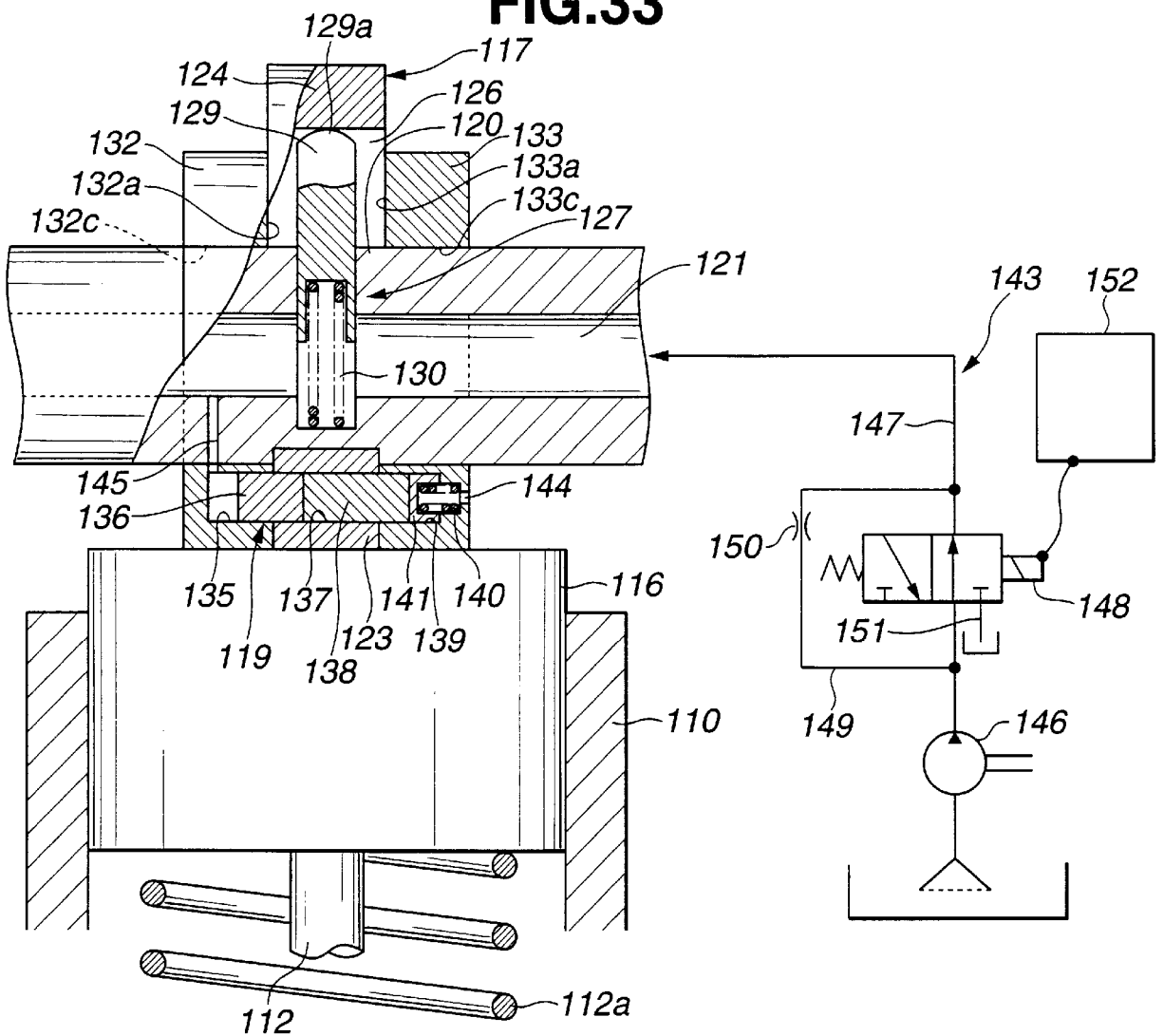
FIG. 33 is a view similar to FIG. 27, showing the movable cam coupled with a camshaft by engaging releasing means in the ninth embodiment.

When the camshaft 113 rotates further (phase θ4) to have the head of the cam nose portion 124 passing the top face of the valve lifter 116 as shown in FIG. 32, the movable cam 117 abuts on the top face of the valve lifter 116 through the other side face of the cam nose portion 124, and lift of the movable cam 117 involves a flank section. Here, a clearance is produced between the movable cam 117 and the valve lifter 116 due to the click phenomenon to cause start of protrusion of the plunger 129. However, since the contact point of the movable cam 117 with the valve lifter 116 is moved to a point e4 in the opposite direction with respect to the center of the valve lifter 116, the movable cam 117 is displaced in phase clockwise, i.e. in the direction of rotation of the camshaft 113, producing the clearance C of an angle Δ between the side faces 120*d*, 126*c*.

When the movable cam 117 rotates further, a section involved of the movable cam 117 passes from the lift section to the base circle section, and returns finally to the state as shown in FIG. 25. Since the direction of contact α0 of the plunger 129 is offset in the direction of rotation of the camshaft 113 with respect to the direction of the axis Y of the plunger 129, the movable cam 117 is restricted by the another side face 126*d* of the slide hole 126 stably abutting on the another side face 120*e* of the camshaft mounting portion 120, obtaining coincidence of the axes of the pistons 136, 138, 141.

In such a way, in the above engine operating area, the movable cam 117 rotates in synchronism with the camshaft 113, but comes in slide contact with the top face of the valve lifter 116 together with the flanges 132, 133 in the zero lift state, carrying out no lift operation to the second intake valve 112. Therefore, the first intake valve 111 is lifted by the stationary cam 114 to carry out opening and closing operation, whereas the second intake valve 112 is put in the valve closed state by a biasing force of the valve spring 112*a*, being retained in the valve stop state. This produces strong swirl in intake air flowing into the cylinder to accelerate combustion, enabling improved fuel consumption.

On the other hand, under high rotation and heavy load of the engine, for example, the solenoid valve 148 is switched in accordance with a control signal of the controller 152 to shut off the drain passage 151 and ensure communication between the upstream and downstream sides of the supply and discharge passage 147. As a result, the high hydraulic pressure discharged from the oil pump 146 is supplied to the piston receiving hole 135 via the supply and discharge passage 147, the oil passage 121, and the oil hole 145. Thus, referring to FIG. 33, when the movable cam 117 rotates to have the base circle portion 123 facing the top face of the valve lifter 116, the receiving hole 135, the engagement hole 137, and the holding hole 139 are aligned as described above, so that the head of the engaging piston 136 protrudes by the high hydraulic pressure within the receiving hole 135 against a biasing force of the spring member 140 so as to push back the pressing piston 138 and the biasing piston 141, engaging with the engagement hole 137. Simultaneously, another end of the pressing piston 138 also engages with the holding hole 139. Thus, with the cam nose portion 124 moving forward maximally, the movable cam 117 engages with the flanges 132, 133 to be integrated with the camshaft 113. The above high hydraulic pressure provides a pressing force to the plunger 129 to prevent the movable cam 117 from running away by an inertia force, obtaining more stable alignment of the three holes 135, 137, 139.

As a result, in the same way as the stationary cam 114, the movable cam 117 can exert a cam lift function with rotation of the camshaft 113 to achieve high lift (lift L1) of the second intake valve 112 as shown in FIG. 36. This improves the filling efficiency of intake air due to opening and closing operation of the two intake valves 111, 112, enabling increased engine output.

With the movable cam 117 coupled with the camshaft 113, the circular inner peripheral surface 126*a* of the one end of the slider opening 126 is supported by the circular outer peripheral surface 120*c* of the one end 120*a* of the mounting portion 120, restraining occurrence of a play between the two. That is, here, since restraint of the movable cam 117 in the direction of rotation is ensured by contact of the circular inner and outer peripheral surfaces 126*a*, 120*c* which can be machined with high accuracy, occurrence of a play between the two can fully be restrained, resulting in restrained occurrence of hammering and one side hit between the two.

Figure 34:
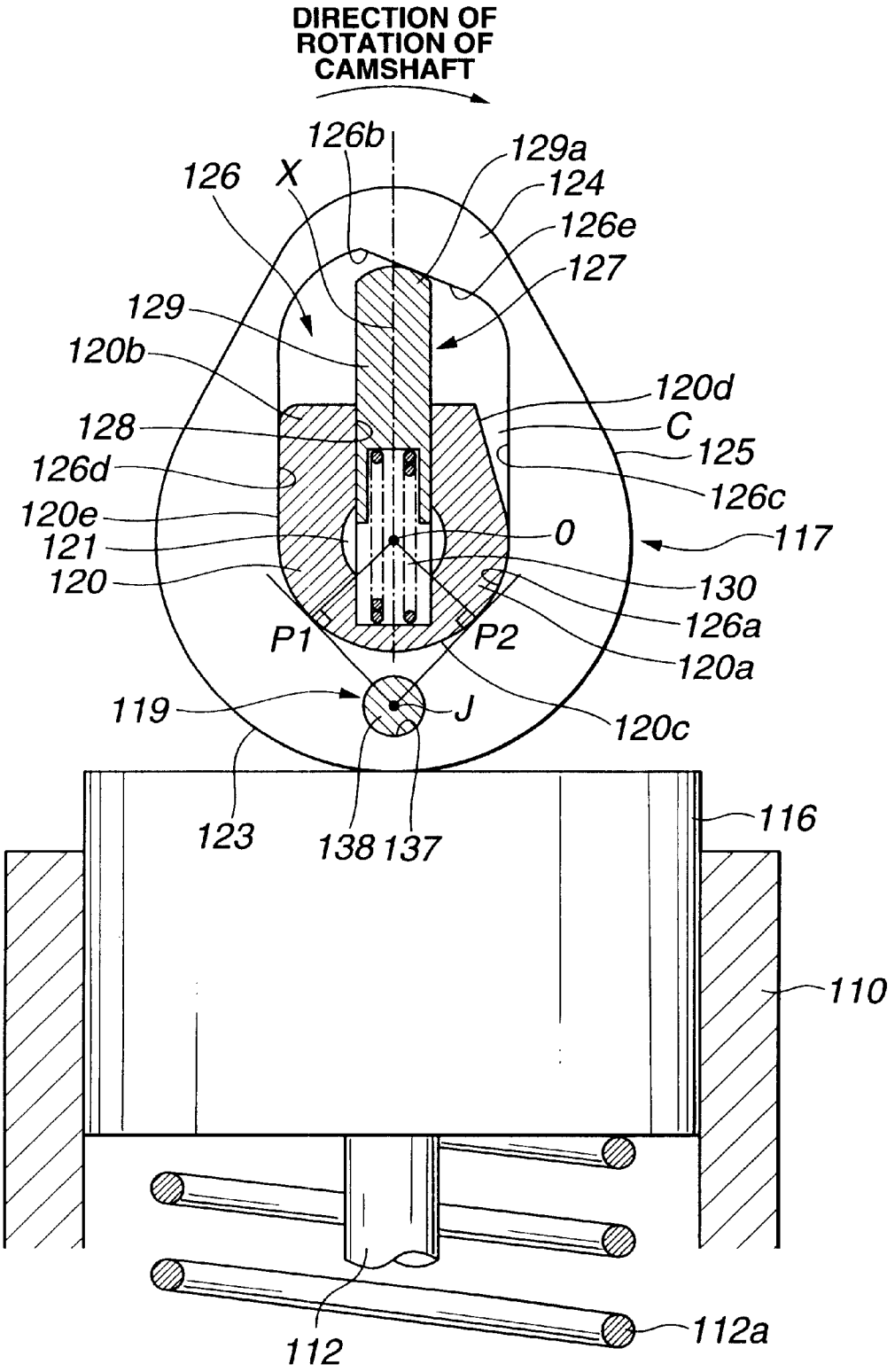
FIG. 34 is a view similar to FIG. 32, showing the movable cam in the supported state.
Figure 35:
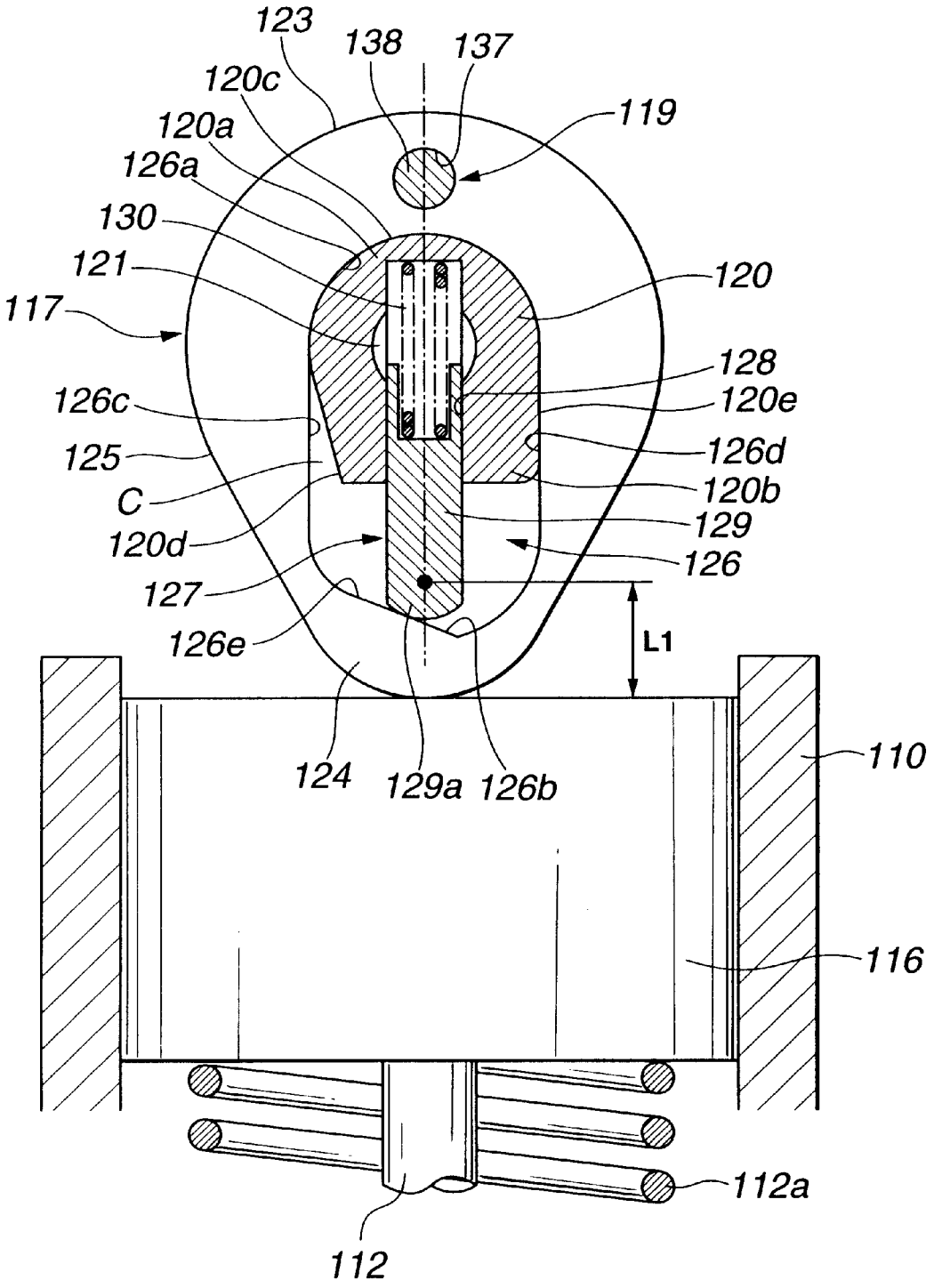
FIG. 35 is a view similar to FIG. 34, showing the movable cam in the lifted state.

Referring to FIG. 34, support operation for the movable cam 117 will be described in a more concretive way. A contact point P1 of the circular inner and outer peripheral surfaces 126*a*, 120*c* restrains clockwise rotation of the movable cam 117, whereas a contact point P2 of the two restrains counterclockwise rotation of the movable cam 117. When an axis of the camshaft 113 is O, and an axis of the engaging piston 136 is J, an angle formed by O, P1 and J, and an angle formed by O, P2 and J are substantially 90° respectively. Therefore, with rotation of the camshaft 113, since the movable cam 117 is fixed to the camshaft 113, the valve lifter 116 and the intake valve 112 are lifted with high lift L1 of the movable cam 117 as shown in FIG. 35. Here, as described above, restraint of the movable cam 117 in the direction of rotation is ensured by contact between the accurate circular inner and outer peripheral surfaces 126*a*, 120*c*, enabling a reduction in occurrence of a play between the two, resulting in restrained occurrence of hammering and one side hit between the two. This prevents an increase in the local surface pressure to allow improved durability of the contact surfaces, preventing occurrence of unequal wear.

Further, since the axis J of the engaging piston 136 is positioned in a longitudinal projection area of the slider opening 126, both clockwise and counterclockwise rotations of the movable cam 117 can effectively be restrained by the inner and outer peripheral surfaces 126*a*, 120*c*, which is more significant than when the axis J is positioned on the side of the movable cam 117.

Furthermore, as described above, the holes 135, 137, 139 are aligned at the position where the another side face 126*d* of the slider opening 126 abuts on the another side face 120*e* of the camshaft mounting portion 120 to restrict clockwise rotation of the movable cam 117, obtaining quick and sure engagement and release of the movable cam 117 from the camshaft 113.

Still further, coupling of the engaging and releasing means 119, i.e. engagement of the engaging piston 136 and the pressing piston 138 with the engagement hole 137 and the holding hole 139, is carried out not only during relative rotation of the camshaft 113 and the movable cam 117, but in the base circle area of the movable cam 117, i.e. in the state of no relative rotation of the two, enabling fully secured engageable time, resulting in stable and surer engagement even during high rotation.

Still further, the biasing means 127 are arranged in the direction of forward motion of the cam nose portion 124 of the movable cam 117, so that when the cam nose portion 124 is pressed by a biasing force of the valve spring 112*a*, backward motion of the movable cam 117 is readily carried out in its entirety through the cam lift portion 24.

Figure 37:
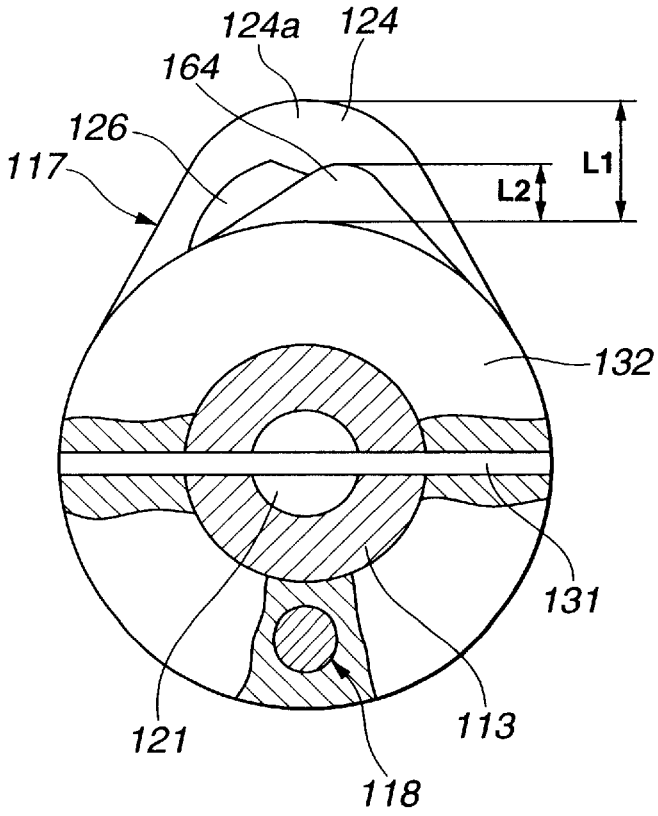
FIG. 37 is a view similar to FIG. 28, showing a tenth embodiment of the present invention.

FIG. 37 shows a tenth embodiment of the present invention wherein at least one of the flanges 132, 133 disposed on both side faces of the movable cam 117 serves as a low-speed cam. Specifically, the cam nose portion 124 of the movable cam 117 is formed higher (L1) to have a cam profile set for high speed, whereas a second cam nose portion 164 lower than the first cam nose portion 124 is formed at the outer periphery of the flange 312 to have a cam profile set for low speed.

According to the tenth embodiment, under low rotation and light lord of the engine, the movable cam 117 swings free, so that when reaching the top face of the valve lifter 116, the first cam nose portion 124 moves backward up to the same level as that of the second cam nose portion 164 of the flange 132. Thus, in this operation area, without being stopped, the second intake valve 112 is actuated in an open and closed way in accordance with the lift characteristics of the second cam nose portion 164 having low valve lift as illustrated by chain line in FIG. 38. This cannot provide an improvement in fuel consumption compared with the valve stop state, but improved combustion, stable engine rotation, and high torque due to a certain generation of swirl in the cylinder.

Figure 38:
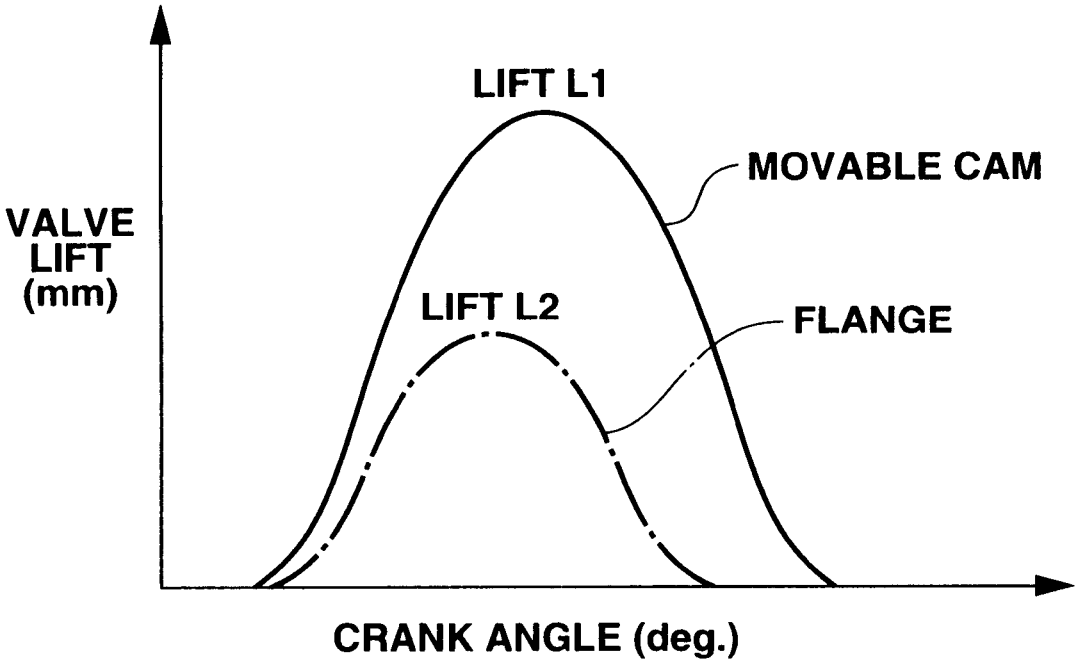
FIG. 38 is a view similar to FIG.36, illustrating valve lift characteristics in the tenth embodiment.

On the other hand, under high rotation and heavy load of the engine, the movable cam 117 and the camshaft 113 are integrated with each other by the engaging releasing means 119, so that the second intake valve 112 is actuated in an open and closed way in accordance with the lift characteristics of the first cam nose portion 124 having high valve lift as illustrated by solid line in FIG. 38, obtaining high engine output.

Figure 39:
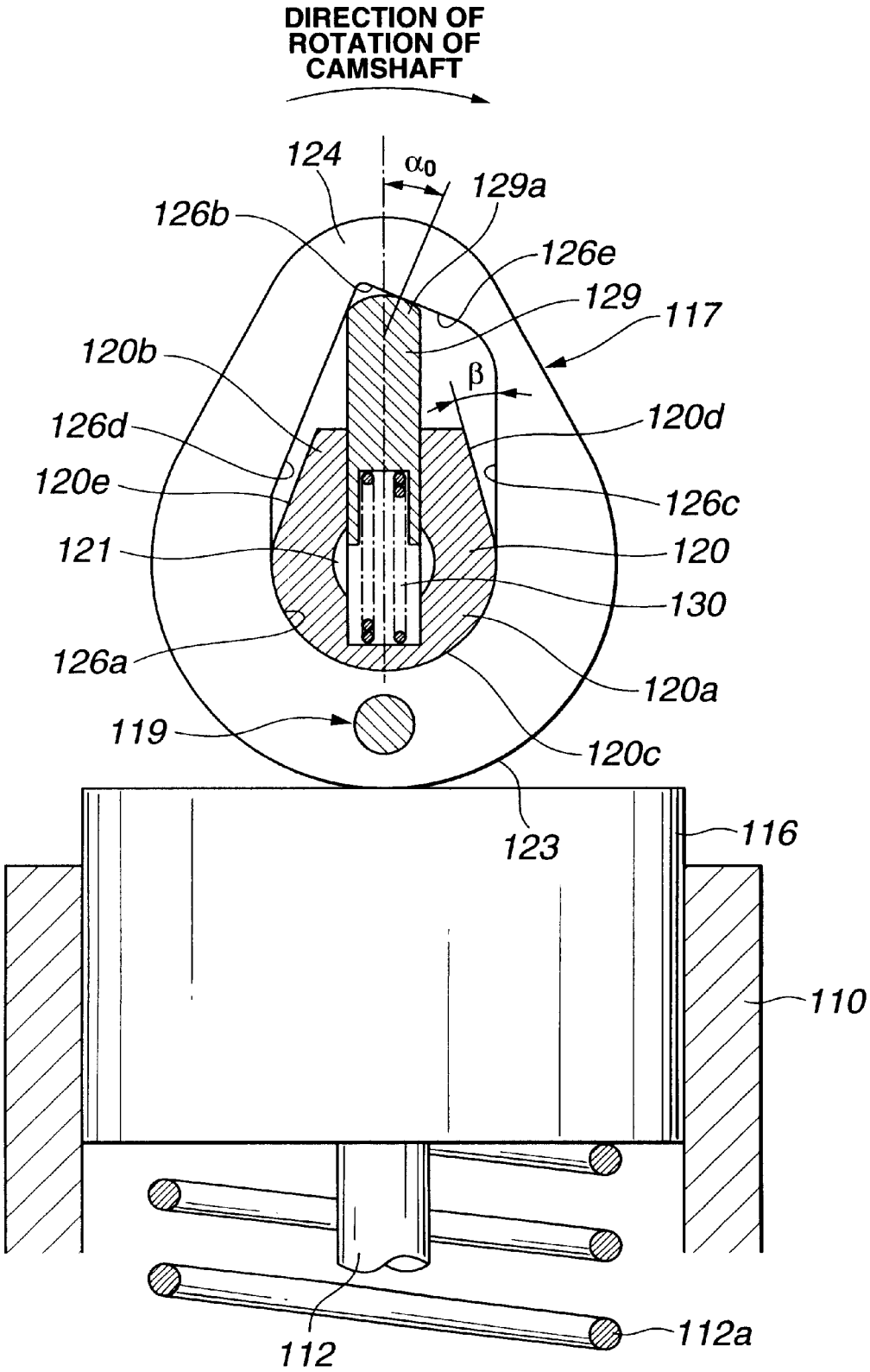
FIG. 39 is a view similar to FIG. 35, showing an eleventh embodiment of the present invention.

FIG. 39 shows an eleventh embodiment of the present invention wherein the means for restricting rotation of the movable cam 117 in the direction of rotation of the camshaft 113 comprise the plunger 129 and the slider opening 126. Specifically, the another side face 120*e* of the camshaft mounting portion 120 is inclined inward in a similar way to the one side face 120*d*, and the another side face 126*d* of the slider opening 126 is inclined inward roughly from the center to the head while maintaining a predetermined clearance with respect to the another side face 120*e*.

According to the eleventh embodiment, even if the movable cam 117 starts to rotate clockwise when the cam nose portion 124 is located upward as shown in FIG. 39, a roughly upper edge of the inclined another side face 126*d* abuts on an edge of the head 129*a* of the plunger 129 as biased to restrict rotation, enabling accurate alignment of the holes 135, 137, 139. Moreover, there is no need to form the restriction face on the camshaft mounting portion 120, facilitating machining of the camshaft 113.

Figure 40:
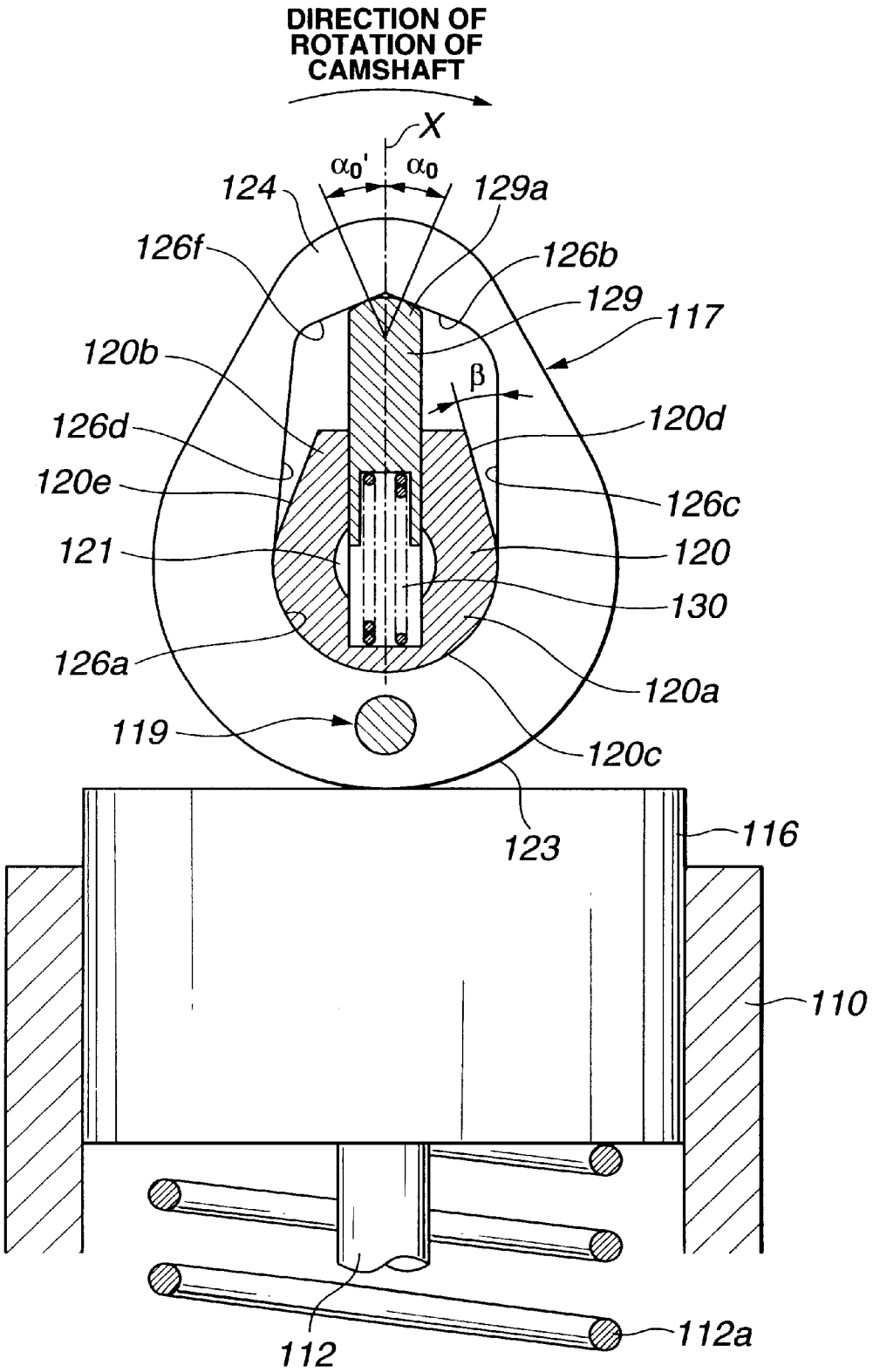
FIG. 40 is a view similar to FIG. 39, showing a twelfth embodiment of the present invention.

FIG. 40 shows a twelfth embodiment of the present invention wherein the rotation restricting means comprise the plunger 129 and the another side face 126*b* of the slider opening 126. A portion of the another side face 126*b* on the backward side as viewed in the direction of rotation of the camshaft 113 and with respect to the center line X of the movable cam 117 is formed like a slant face inclined upward to the center line X so as to define a restriction face 126*f*, which abuts on the edge of the head 129*a* of the plunger 129 to restrict rotation of the movable cam 117 in the direction of rotation of the camshaft 113. An angle a $\alpha 0$ of restriction is set to substantially be equal to another angle $\alpha 0$ of restriction.

According to the twelfth embodiment, a side force of the plunger 129 is cancelled to reduce an inclination of the plunger 129, resulting in improved positioning accuracy of the movable cam 117 and excellent switching performance of the engaging releasing means 119.

Having described the present invention with regard to the preferred embodiments, it is noted that the present invention is not limited thereto, and various changes and modifications can be made without departing from the scope of the present invention. By way of example, the shape of the cam lift or nose portion or the ramp or flank portion of the movable cam on the down side of valve lift may be modified differently to reduce collision of the movable cam with the valve lifter immediately after completion of lift of the movable cam. Further, the present invention can be applied to both intake valves to carry out cylinder stop control.

The entire contents of Japanese Patent Applications 2000-69985, 2000-197556, 2000-242228, and 11-309140 are incorporated hereby by reference.

What is claimed is:

1. An internal combustion engine with a valve, comprising:

a camshaft;

a cam which actuates the valve by torque of said camshaft, said cam being movable in a radial direction of said camshaft, said cam including a lift portion which moves forward and backward in a direction of the valve and a base circle portion, said cam having in a substantial center an opening for allowing forward and backward motion of said cam with respect to said camshaft, said opening having a portion corresponding to said base circle portion and engaged with said camshaft when said lift portion of said cam is maintained in a protruding position;

a support mechanism which rotates said cam with said camshaft; and a first device which engages said cam with said camshaft and releases said cam from said camshaft in accordance with engine operating conditions.

2. The internal combustion engine as claimed in claim 1, further comprising an oil passage which ensures supply of hydraulic fluid between an inner surface of said portion of said opening of said cam and a facing outer peripheral surface of said camshaft.

3. The internal combustion engine as claimed in claim 1, wherein said portion of said opening of said cam is formed roughly circularly along an outer peripheral surface of said camshaft.

4. The internal combustion engine as claimed in claim 3, wherein a clearance is formed between said outer peripheral surface of said camshaft and said opening of said cam, said clearance allowing a predetermined amount of rotation of said cam with respect to said camshaft and in a direction opposite to a direction of rotation of said camshaft when said lift portion of said cam presses an upper end of the valve.

5. The internal combustion engine as claimed in claim 4, further comprising a restricting device for restricting rotation of said cam in said direction of rotation of said camshaft over a predetermined value.

6. The internal combustion engine as claimed in claim 5, wherein said restricting device comprises said cam and said opening of said cam.

7. The internal combustion engine as claimed in claim 6, wherein said opening of said cam has at a lift-portion side end a slant face for biasing said cam in said direction of rotation of said camshaft.

8. The internal combustion engine as claimed in claim 7, wherein said restricting device and said slant face cooperate to define a position of rotation of said cam in said direction of rotation of said camshaft.

9. The internal combustion engine as claimed in claim 8, wherein said cam is engaged with said camshaft by said first device in a position where said cam is restricted by said restricting device.

10. The internal combustion engine as claimed in claim 5, wherein said restricting device comprises a plunger and said opening of said cam.

11. The internal combustion engine as claimed in claim 1, wherein said support mechanism comprises a flange arranged adjacent to said cam and a pin extending between said flange and said cam for swingably supporting said cam to said flange.

12. The internal combustion engine as claimed in claim 11, wherein said flange includes two portions arranged on both sides of said cam.

13. The internal combustion engine as claimed in claim 11, wherein said pin is disposed at a position of said cam in a vicinity of lift start point of a profile of said cam.

14. The internal combustion engine as claimed in claim 13, wherein said first device is disposed in a substantially 180° circumferential position with respect to said pin.

15. The internal combustion engine as claimed in claim 14, wherein said first device comprises a receiving hole formed in a side face of said flange facing said cam, an engagement hole formed through said cam to face said receiving hole, an engaging piston slidably arranged in said receiving hole and having a head to be engaged with said engagement hole by hydraulic fluid supplied to a hydraulic chamber formed in said receiving hole so as to engage said movable cam with said flange, a biasing device for biasing said engaging piston toward said receiving hole, and a hydraulic circuit for selectively supplying and discharging hydraulic fluid from said hydraulic chamber.

16. The internal combustion engine as claimed in claim 15, wherein said biasing device comprises a piston slidably arranged in said engagement hole to abut on a head of said engaging piston.

17. The internal combustion engine as claimed in claim 16, wherein said engagement hole is positioned so that when said lift portion of said cam moves backward maximally, an end of said biasing piston faces said side face of said flange.

18. The internal combustion engine as claimed in claim 1, further comprising a second device which biases said lift portion of said cam toward the valve.

19. The internal combustion engine as claimed in claim 18, wherein said second device comprises a hole substantially radially formed in said camshaft, a plunger slidably arranged in said hole to move in a direction of an inner peripheral surface of said opening of said cam, and a spring member for biasing said plunger toward said inner peripheral surface of said opening so as to move forward said lift portion of said cam.

20. The internal combustion engine as claimed in claim 19, wherein said spring member has a biasing force which is set to substantially be zero when said lift portion moves forward maximally.

21. The internal combustion engine as claimed in claim 19, wherein an engagement recess is formed in said inner peripheral surface of said opening of said cam, with which a head of said plunger is engaged.

22. The internal combustion engine as claimed in claim 21, wherein said engagement recess is positioned forward from a top of said lift portion of said cam as viewed in a direction of rotation of said cam so that said plunger protrudes slantwise in said direction of rotation of said cam with respect to a line connecting said top of said lift portion and an axis of said camshaft.

23. The internal combustion engine as claimed in claim 19, wherein said support mechanism comprises a connecting rod having one end abutting on a bottom of said plunger and another end formed radially through said camshaft to come in slide contact with said inner peripheral surface of said opening of said cam opposite to said head of said plunger.

24. The internal combustion engine as claimed in claim 23, wherein at least in a maximally protruding position of said cam with respect to said camshaft, a small clearance is defined between said another end of said connecting rod and said inner peripheral surface of said opening of said cam.

25. An internal combustion engine with a valve, comprising;

a camshaft;

a cam which actuates the valve by torque of said camshaft, said cam being movable in a radial direction of said camshaft, said cam including a lift portion which moves forward and backward in a direction of the valve and a base circle portion, said cam having in a substantial center an opening for allowing forward and backward motion of said cam with respect to said camshaft, said opening having a portion corresponding to said base circle portion and engaged with said camshaft when said lift portion of said cam is maintained in a protruding position;

a support mechanism which rotates said cam with said camshaft; and means for engaging said cam with said camshaft and releasing said cam from said camshaft in accordance with engine operating conditions.

26. An internal combustion engine with a valve, comprising:

a camshaft;

a cam which actuates the valve by torque of said camshaft, said cam being movable in a radial direction of said camshaft, said cam including a lift portion which moves forward and backward in a direction of the valve and a base circle portion;

a support mechanism which rotates said cam with said camshaft; and a first device which engages said cam with said camshaft and releases said cam from said camshaft in accordance with engine operating conditions, wherein said cam is moved in said radial direction per rotation of said camshaft when said cam is released from said camshaft.

27. An internal combustion engine with a valve, comprising:

a camshaft;

a cam which actuates the valve by torque of said camshaft, said cam being movable in a radial direction of said camshaft, said cam including a lift portion which moves forward and backward in a direction of the valve and a base circle portion;

a support mechanism which rotates said cam with said camshaft; and means for engaging said cam with said camshaft and releasing said cam from said camshaft in accordance with engine operating conditions, wherein said cam is moved in said radial direction per rotation of said camshaft when said cam is released from said camshaft.

* * * * *